US007942310B2

(12) United States Patent
Dominski et al.

(10) Patent No.: US 7,942,310 B2
(45) Date of Patent: May 17, 2011

(54) CONTAINER

(75) Inventors: Dan Dominski, Highland Village, TX (US); Brad Moore, Haltom City, TX (US)

(73) Assignee: Mary Kay Inc., Dallas, TX (US)

( * ) Notice: Subject to any disclaimer, the term of this patent is extended or adjusted under 35 U.S.C. 154(b) by 584 days.

(21) Appl. No.: 11/777,616

(22) Filed: Jul. 13, 2007

(65) Prior Publication Data

US 2008/0135560 A1 Jun. 12, 2008

Related U.S. Application Data

(60) Provisional application No. 60/862,853, filed on Oct. 25, 2006.

(51) Int. Cl.

| | |
|---|---|
| ***B65D 25/04*** | (2006.01) |
| ***B65D 25/00*** | (2006.01) |
| ***B65D 1/24*** | (2006.01) |
| ***B65D 1/36*** | (2006.01) |
| ***B65D 57/00*** | (2006.01) |
| ***B65D 85/00*** | (2006.01) |

(52) U.S. Cl. ..... 229/120.17; 220/507; 220/62

(58) Field of Classification Search ..... 229/120.17, 229/120.03, 185, 120.16; 220/507, 62, 533, 220/552; 206/182–191

See application file for complete search history.

(56) References Cited

U.S. PATENT DOCUMENTS

| | | | | | |
|---|---|---|---|---|---|
| 557,371 | A | * | 3/1896 | Ferguson | 229/120.04 |
| 1,854,955 | A | * | 4/1932 | Reaume et al. | 206/162 |
| 2,089,067 | A | * | 8/1937 | Myers | 229/120.08 |
| 2,524,516 | A | * | 10/1950 | Cody | 229/120.17 |
| 2,586,886 | A | * | 2/1952 | Tyrseck | 229/120.17 |
| 2,662,682 | A | * | 12/1953 | Bolding | 229/120.13 |
| 2,665,026 | A | | 1/1954 | Katzman | 217/22 |
| 2,693,308 | A | * | 11/1954 | Gircux et al. | 229/120.03 |
| 2,693,309 | A | * | 11/1954 | Giroux et al. | 229/120.04 |
| 2,830,697 | A | * | 4/1958 | Eaton | 206/45.29 |
| 3,118,589 | A | | 1/1964 | Hughes | 229/120.17 |
| 3,145,902 | A | * | 8/1964 | Nolen | 229/120.03 |
| 3,184,143 | A | | 5/1965 | Kotowick | 229/120.17 |
| 3,326,444 | A | | 6/1967 | Farquhar | 229/120.18 |
| 3,363,824 | A | | 1/1968 | Murata | 206/511 |
| 3,825,174 | A | | 7/1974 | Booth, Jr. | 229/120.17 |
| 3,952,941 | A | * | 4/1976 | Zimmerman | 229/117 |
| 3,985,288 | A | | 10/1976 | Bell | 229/115 |
| 4,067,492 | A | | 1/1978 | Gargan | 229/120.25 |
| 4,148,427 | A | | 4/1979 | Baker | 206/423 |
| 4,172,550 | A | | 10/1979 | Garmon | 229/120.17 |
| D253,520 | S | | 11/1979 | Dempster | D9/433 |
| 4,211,359 | A | | 7/1980 | Chaffin | 229/120.17 |
| 4,294,397 | A | | 10/1981 | Kohler | 229/120.08 |
| D262,357 | S | | 12/1981 | Kohler | D9/433 |
| 4,320,867 | A | | 3/1982 | Gardner | 229/120.26 |
| 4,342,417 | A | | 8/1982 | Forbes, Jr. | 229/120.08 |
| 4,347,967 | A | | 9/1982 | Loudermilk, Jr. | 229/120.17 |
| 4,376,508 | A | | 3/1983 | Gardner et al. | 229/120.17 |
| 4,489,878 | A | | 12/1984 | Mode | 229/117 |
| 4,574,996 | A | | 3/1986 | Brian | 229/120.17 |

(Continued)

*Primary Examiner* — Nathan J Newhouse
*Assistant Examiner* — Latrice Byrd
(74) *Attorney, Agent, or Firm* — Fulbright & Jaworski L.L.P.

(57) ABSTRACT

A container that can be constructed from a blank is disclosed. The container can include four side walls and can be divided into multiple cells. The size or shape of the cell(s) can be substantially similar or can be varied. For instance, the cell(s) can be varied to correspond to the size or shape of a particular article of manufacture.

27 Claims, 21 Drawing Sheets

U.S. PATENT DOCUMENTS

| | | | | | |
|---|---|---|---|---|---|
| 4,671,450 | A | * | 6/1987 | Lopez | 229/120.17 |
| 4,944,405 | A | | 7/1990 | Buford et al. | 229/240 |
| D329,375 | S | | 9/1992 | Bergman | D9/759 |
| 5,579,990 | A | * | 12/1996 | Durand | 229/120.17 |
| 5,938,109 | A | | 8/1999 | Sainz et al. | 229/120.21 |
| 6,012,630 | A | | 1/2000 | Block | 229/120.17 |
| 6,516,951 | B2 | | 2/2003 | Sears et al. | 206/541 |
| 6,840,437 | B2 | | 1/2005 | Chen | 229/120.17 |
| 7,004,314 | B2 | | 2/2006 | Pucillo et al. | 206/217 |
| 7,172,109 | B2 | * | 2/2007 | Kuenstler et al. | 229/120.13 |
| 2005/0067475 | A1 | | 3/2005 | Duyst | 229/120.17 |
| 2006/0022023 | A1 | | 2/2006 | Kuenstler et al. | 229/120.13 |

* cited by examiner

CONTAINER

CROSS-REFERENCE TO RELATED APPLICATIONS

This application claims the benefit of U.S. Provisional Application Ser. No. 60/862,853, filed Oct. 25, 2006, the contents of which are incorporated by reference.

BACKGROUND OF THE INVENTION

A. Field of the Invention

The present invention concerns a container that can be used to hold or transport matter (e.g., objects such as articles of manufacture).

B. Description of Related Art

Containers that include internal dividers are known. These containers can have reduced stability and strength. This can lead to damage of any articles of manufacture that are included in the containers.

SUMMARY OF THE INVENTION

The present invention overcomes deficiencies in the art by providing containers that can be used to hold or transport matter. Non-limiting examples of matter include things that have mass and occupy space (e.g., objects such as articles of manufacture).

In one non-limiting embodiment, there is provided a container comprising: a first, second, third, and fourth side wall panel, wherein the first and third side wall panels are in opposed relationship, and wherein the second and fourth side wall panels are in opposed relationship, the side wall panels defining an interior space of the container; a first second, third, and fourth bottom panel, wherein the first bottom panel is coupled to the first side wall panel, the second bottom panel is coupled to the second side wall panel, the third bottom panel is coupled to the third side wall panel, and the fourth bottom panel is coupled to the fourth side wall panel, and wherein each bottom panel comprises: (a) a divider portion that extends into the interior of the container and is configured to form a cell wall that defines a cell; and (b) a bottom portion. In another non-limiting embodiment, the first, second and fourth bottom panels comprise a bottom portion and a divider portion, while the third bottom panel comprises only a bottom portion. In certain aspects, the divider portions can all have the same or different aspect ratios. For instance, the divider portions of the second and fourth bottom panels can have different aspect ratios or the same aspect ratios when compared to one another. Similarly, the divider portions of the first and third bottom panels can have the same or different aspect ratios when compared to one another or when compared to the second and for bottom panels. In one embodiment, the second and fourth bottom panels have different aspect ratios when compared to one another. The first and third bottom panels can have similar aspect ratios when compared to one another. The container can include a first fold line that defines a boundary between each side wall panel and each bottom panel, and a second fold line that defines a boundary between the divider portion and the bottom portion of each bottom panel. The distance between the first fold line and second fold line of the second bottom panel can be the same, less than, or greater than the distance between the first fold line and second fold line of the fourth bottom panel. In certain aspects, the distance between the first fold line and the second fold line of the first bottom panel is substantially similar to the distance between the first fold line and the second fold line of the third bottom panel.

The interior space of the container can comprise or be divided into 1, 2, 3, 4, 5, 6, 7, 8, 9, 10, 11, 12, 13, 14, or more cells. In certain embodiments, the container can be divided into 4 or 6 cells. In a 4 cell container, the cells can be further divided into two sets of two. In a six cell container, the cells can be further divided into two sets of three. The first set of cells can have the same or different shape when compared to one another. The second set of cells can also have the same or different shape when compared to one another. In certain aspects, the first set of cells can have a smaller, the same, or larger interior space in comparison to the cells in the second set. A non-limiting way to measure the interior space of a cell is by volume. By way of example only, the first set of cells can have the same shape when compared to one another and can have a smaller interior space in comparison to the second set of cells which can also have the same shape when compared to one another.

The container can be folded in such a way that each divider portion can be capable of being folded in such a way that the interior space of the container is either not divided or else it is divided into 1, 2, 3, 4, 5, 6, 7, 8, 9, 10, 11, 12, 13, 14, or more cells. The bottom portions of the second and fourth bottom panels can be adapted to form the outside surface of the bottom of the container. The first and third bottom panels can further comprise elongated openings that are configured to accept the divider portions of the second and fourth bottom panels. In certain embodiments, the divider portions of the second and fourth bottom panels can further comprise 1, 2, 3, 4, 5, 6, 7, 8, or more sub-panels.

The container can further include a first, second, third, and fourth top panel. The first top panel can be coupled to the first side wall panel, the second top panel can be coupled to the second side wall panel, the third top panel can be coupled to the third side wall panel, and the fourth top panel can be coupled to the fourth side wall panel. The top panels can be adapted to fold in such a way so as to enclose the top portion of the container. Alternatively, a lid that is separate from the container blank can be used to enclose the top portion of the container. The first and third side wall panels can further include apertures that form handles. The second and fourth side wall panels can further comprise apertures that form handles. Handles can be used to assist the user to pick of the box.

The container can have a multitude of shapes. In one embodiment, the container has a rectangular shape. However, other shapes such as, but not limited to, a square, a hexagonal, and an octagonal shape are contemplated. The container can also be made from multiple blanks of material or a single blank of material. In certain aspects, a single blank of material is used, and the container can be made by scoring and/or cutting the blank.

In another non-limiting embodiment, there is provided a container comprising: a first, second, third, and fourth side wall panel, wherein the first and third side wall panels are in opposed relationship, and wherein the second and fourth side wall panels are in opposed relationship, the side wall panels defining an interior space of the container; a first second, third, and fourth bottom panel, wherein the first bottom panel is coupled to the first side wall panel, the second bottom panel is coupled to the second side wall panel, the third bottom panel is coupled to the third side wall panel, and the fourth bottom panel is coupled to the fourth side wall panel, and wherein each bottom panel comprises: (a) a divider portion that extends into the interior of the container and is capable of being folded in such a way that the interior space of the container is either not divided or else it is divided into multiple cells (e.g., 1, 2, 3, 4, 5, 6, 7, 8, 9, 10, 11, 12, 13, 14, or more); and (b) a bottom portion. In another non-limiting embodiment, the first, second and fourth bottom panels comprise a bottom portion and a divider portion, while the third bottom panel comprises only a bottom portion.

Also disclosed is a single blank of material for constructing a container. The blank can be made of any material that can be used to form a container. Non-limiting examples include cardboard, corrugated paper, plastics, metals, fibers, clothes, etc. The blank can include a first, second, third, and fourth side wall panel, wherein the first and third side wall panels are in opposed relationship, and wherein the second and fourth side wall panels are in opposed relationship, the side wall panels being configured to define an interior space when the container is formed; a glue joint coupled to the first side wall panel (as indicated above, the glue joint can also be coupled to the fourth side wall panel; a first second, third, and fourth bottom panel, wherein the first bottom panel is coupled to the first side wall panel, the second bottom panel is coupled to the second side wall panel, the third bottom panel is coupled to the third side wall panel, and the fourth bottom panel is coupled to the fourth side wall panel, and wherein each bottom panel comprises: (a) a divider portion that is configured to extend into the interior of the container when the container is formed; and (b) a bottom portion, wherein the divider portions of the first and third bottom panels have the same aspect ratio and the divider portions of the second and fourth bottom panels have different aspect ratios. In another non-limiting embodiment, the first, second and fourth bottom panels comprise a bottom portion and a divider portion, while the third bottom panel comprises only a bottom portion. As indicated above, the divider portions can all have the same or different aspect ratios. For instance, the divider portions of the second and fourth bottom panels can have different aspect ratios or the same aspect ratios when compared to one another. Similarly, the divider portions of the first and third bottom panels can have the same or different aspect ratios when compared to one another or when compared to the second and for bottom panels. In one embodiment, the second and fourth bottom panels have different aspect ratios when compared to one another, and the first and third bottom panels have similar aspect ratios when compared to one another. In certain aspects, the blank has a rectangular shape. However, other shapes such as, but not limited to, a square, a hexagonal, and an octagonal shape are contemplated. The blank can be cut from a material by using a stamping machine. For instance, a single piece of material can be used to prepare multiple blanks by placing the material in a stamp machine (e.g., assembly line manufacture). This can be advantageous for speed of production and/or to minimize waste material (e.g., material that is not part of the blank). Additionally, the design of the blank allows for the use of a stamping machine while preserving the symmetrical or asymmetrical fold patterns.

In yet another embodiment, there is disclosed a container comprising: a first, second, third, and fourth side wall panel, wherein the first and third side wall panels are in opposed relationship, and wherein the second and fourth side wall panels are in opposed relationship, the side wall panels defining an interior space of the container; a first second, third, and fourth bottom panel, wherein the first bottom panel is coupled to the first side wall panel, the second bottom panel is coupled to the second side wall panel, the third bottom panel is coupled to the third side wall panel, and the fourth bottom panel is coupled to the fourth side wall panel, wherein a first fold line defines a boundary between each side wall panel and each bottom panel, and wherein each bottom panel comprises: (a) a divider portion that extends into the interior of the container and is configured to form a cell wall that defines a cell; and (b) a bottom portion, wherein a second fold line defines a boundary between the divider portion and the bottom portion of each bottom panel, and wherein the distance between the first fold line and the second fold line of the second bottom panel is greater than the distance between the first fold line and second fold line of the fourth bottom panel. In another non-limiting embodiment, the first, second and fourth bottom panels comprise a bottom portion and a divider portion, while the third bottom panel comprises only a bottom portion. As noted above, the distance between the first fold line and the second fold line of the first bottom panel can be substantially similar to the distance between the first fold line and the second fold line of the third bottom panel.

In still another embodiment, a container of the present invention can include a first, second, third, and fourth side wall panel, wherein the first and third side wall panels are in opposed relationship, and wherein the second and fourth side wall panels are in opposed relationship, the side wall panels defining an interior space of the container; a first second, third, and fourth bottom panel, wherein the first bottom panel is coupled to the first side wall panel, the second bottom panel is coupled to the second side wall panel, the third bottom panel is coupled to the third side wall panel, and the fourth bottom panel is coupled to the fourth side wall panel, and wherein each bottom panel comprises: (a) a divider portion that extends into the interior of the container and is capable of forming a cell wall defining a cell and/or a portion of the bottom of the container; and (b) a bottom portion. In another non-limiting embodiment, the first, second and fourth bottom panels comprise a bottom portion and a divider portion, while the third bottom panel comprises only a bottom portion. As discussed above, the interior space of the container can either not be divided or else it is divided into multiple cells.

Methods for using the container of the present invention are also contemplated. Non-limiting methods include methods for shipping, storing, or displaying articles of manufacture (e.g., consumer products). Also contemplated is a method for reducing the damage of an article of manufacture during shipping or storage comprising placing the article of manufacture in a container of the present invention, wherein the likelihood of damage to the article during storage or shipping is reduced when compared to a container that is known in the prior art.

It is contemplated that any embodiment discussed in this specification can be implemented with respect to any method or container of the invention, and vice versa. Furthermore, containers of the invention can be used to achieve methods of the invention.

The term "about" or "approximately" are defined as being close to as understood by one of ordinary skill in the art, and in one non-limiting embodiment the terms are defined to be within 10%, preferably within 5%, more preferably within 1%, and most preferably within 0.5%.

The use of the word "a" or "an" when used in conjunction with the term "comprising" in the claims and/or the specification may mean "one," but it is also consistent with the meaning of "one or more," "at least one," and "one or more than one."

The use of the term "or" in the claims and specification includes "and/or" unless explicitly indicated to refer to alternatives only or the alternatives are mutually exclusive, although the disclosure supports a definition that refers to only alternatives and "and/or."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

Other objects, features and advantages of the present invention will become apparent from the following detailed description. It should be understood, however, that the detailed description and the examples, while indicating specific embodiments of the invention, are given by way of illustration only. Additionally, it is contemplated that changes and modifications within the spirit and scope of the invention will become apparent to those skilled in the art from this detailed description.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific non-limiting embodiments presented herein. These drawings illustrate by way of example and not limitation, and they use like references to indicate similar elements.

DESCRIPTION OF ILLUSTRATIVE EMBODIMENTS

The containers of the present invention provide several non-limiting benefits over prior art container. For instance, the containers have increased production speed and minimized waste material during construction. Additionally, the containers have an increased ability to protect items during the shipping and storage.

In certain non-limiting aspects, a container of the present invention can be made from a one-piece blank. The container can include asymmetrical fold patterns that can provide stability or strength to the container. In certain aspects, the asymmetrical folds can be created by varying the aspect ratios of divider portions and bottom portions of the containers. In other non-limiting aspects, a portion of the interior space of the container can be divided into multiple cell(s) as needed. The size and shape of the cell(s) can be substantially similar or can be varied. For instance, the cell(s) can be varied to correspond to the size or shape of a particular article of manufacture. In some aspects, the interior space of the container can be divided into multiple cells that have different sizes or shapes to accommodate different sizes or shapes of articles of manufacture. This can allow a user to store or ship articles of manufacture of different sizes or shapes in one container. These and other aspects of the present invention are described throughout this specification.

A. Blank

Figure 1:
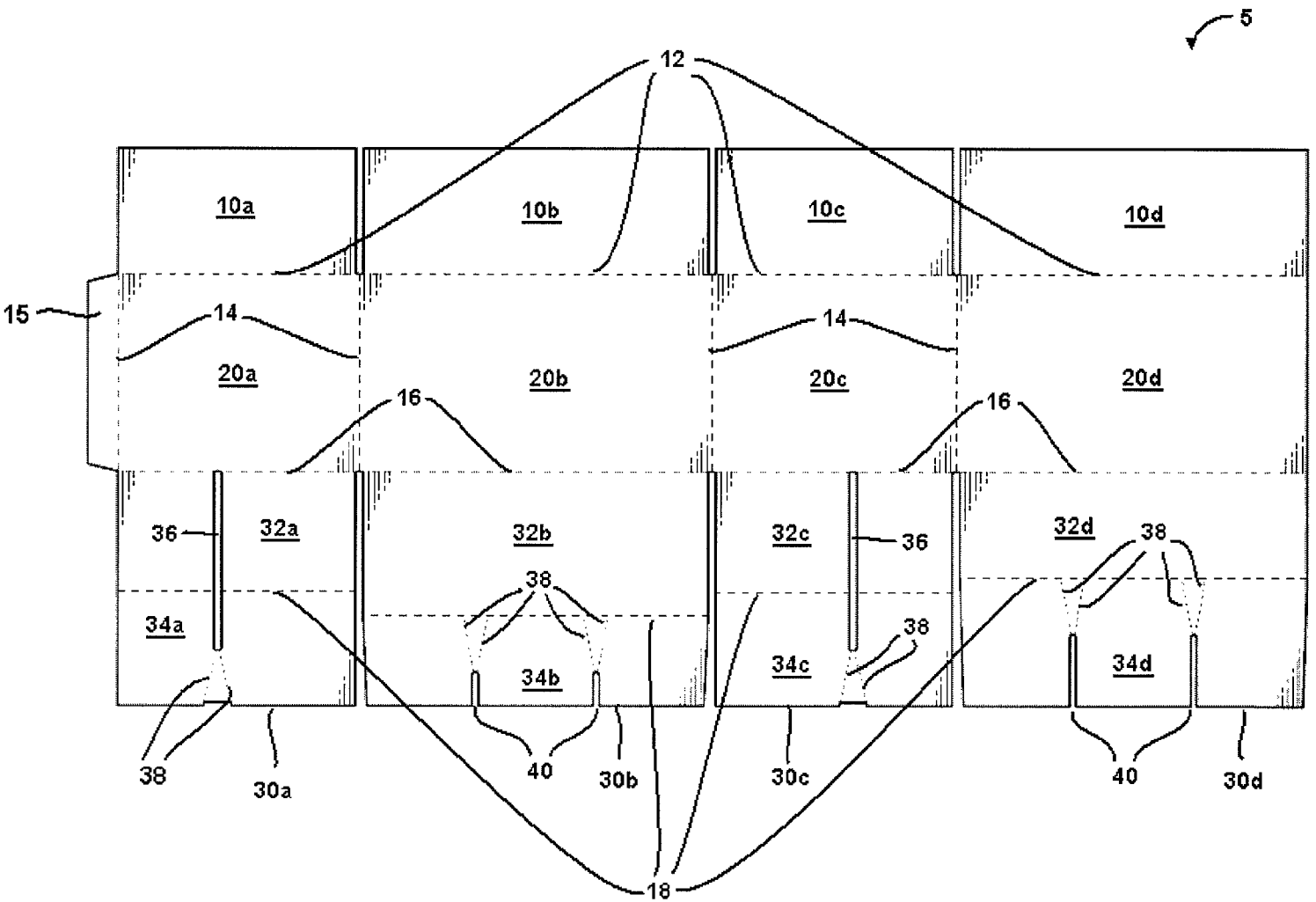
FIG. 1 is a plain view of a one-piece blank that can be used to construct one embodiment of a container of the present invention.

FIG. 1 shows a blank 5 that can be used to construct a container of the present invention. The blank 5 includes four top panels 10*a*, 10*b*, 10*c*, and 10*d*, which can be configured to form a top portion of the constructed container. The blank 5 also includes four side panels 20*a*, 20*b*, 20*c*, and 20*d*, and four bottom panels 30*a*, 30*b*, 30*c*, and 30*d*. A glue joint 15 is coupled to side panel 20*a*. When the blank 5 is constructed into a container, the glue joint 15 can be used to connect itself to side panel 20*d*, thereby defining an interior space of the container, where side panels 20*a* and 20*c* are in opposed relationship, and side panels 20*b* and 20*d* are in opposed relationship. In a non-limiting embodiment, the connection can be made by using an adhesive. However, the connection can be made in other ways (e.g., mechanical devices such as a staple, a screw, a nail, a clamp, etc.). In other embodiments, glue joint 15 can be coupled to side panel 20*d* and can be configured to connect side panel 20*d* to side panel 20*a*.

Fold lines 12 define boundaries between each top panel 10*a*, 10*b*, 10*c*, and 10*d* and each corresponding side panel 20*a*, 20*b*, 20*c*, and 20*d*. Fold lines 14 define boundaries between the glue joint 15 and side panel 20*a* and between side panels 20*a*, 20*b*, 20*c*, and 20*d*. Fold lines 16 define boundaries between each side panel 20*a*, 20*b*, 20*c*, and 20*d* and each corresponding bottom panel 30*a*, 30*b*, 30*c*, and 30*d*.

Each bottom panel 30*a*, 30*b*, 30*c*, and 30*d* comprises a bottom portion 32*a*, 32*b*, 32*c*, and 32*d* and a divider portion 34*a*, 34*b*, 34*c*, and 34*d*. Bottom portions 32*b* and 32*d* can be configured to form the outside bottom surface of the formed container, while bottom portions 32*a* and 32*c* can be configured to form at least part of the inside bottom surface of the formed container. In other embodiments, bottom portions 32*a* and 32*c* can be configured to form the outside bottom surface of the formed container, while bottom portions 32*b* and 32*d* can be configured to form at least part of the inside bottom surface of the formed container. Bottom panels 30*a* and 30*c* each comprise an elongated opening 36 that can be configured to accept at least part of divider portions 34*b* and 34*d* when the container is formed. The elongated openings 36 extend from fold lines 16 into at least part of bottom portions

34*a* and 34*c*. In other non-limiting aspects, the size and length of the elongated openings 36 can be varied as desired (e.g., they can extend into the bottom portion only or the entire length of the bottom panel).

Fold lines 18 define boundaries between each bottom portion 32*a*, 32*b*, 32*c*, and 32*d* and each corresponding divider portion 34*a*, 34*b*, 34*c*, and 34*d*. The distance between fold line 16 and fold line 18 of bottom panel 30*a* is substantially similar to the distance between fold line 16 and fold line 18 of bottom panel 30*c*. The distance between fold line 16 and fold line 18 of bottom panel 30*b* is greater than the distance between fold line 16 and fold line 18 of bottom panel 30*d*. In other non-limiting embodiments, the distance between fold line 16 and fold line 18 of bottom panel 30*a* can be different (e.g., greater or smaller) when compared to the distance between fold line 16 and fold line 18 of bottom panel 30*c*, and the distance between fold line 16 and fold line 18 of bottom panel 30*b* can be substantially similar to the distance between fold line 16 and fold line 18 of bottom panel 30*d*. Divider portions 34*a* and 34*c* have substantially similar aspect ratios, and divider portions 34*b* and 34*d* have different aspect ratios. In other non-limiting embodiments, divider portions 34*a* and 34*c* can have different aspect ratios. Similarly, divider portions 34*b* and 34*d* can have the same aspect ratios. Divider portions 34*a*, 34*b*, 34*c*, and 34*d* can be configured to extend into the interior of the formed container. Each divider portion 34*a*, 34*b*, 34*c*, and 34*d* includes cut lines 38 that allow a user to reconfigure the interior space of the formed container. For example, the cut lines 38 can be separated or cut along the indicated line 38. This allows the interior space of the formed container to include 0, 1, 2, 3, 4, 5, or 6 individual cells by folding selected parts of the divider portions 34*a*, 34*b*, 34*c*, and 34*d* downward to the bottom surface of the formed container. Divider portions 34*b* and 34*d* also include elongated slits 40 which can facilitate the positioning of divider portions 34*b* and 34*d* with respect to divider portions 34*a* and 34*c* when the container is constructed.

B. Container

In certain non-limiting aspects, containers of the present invention can be constructed from corrugated paperboard (e.g., cardboard). Materials other than corrugated paperboard can also be used (e.g., plastics, metals, composite materials, etc.).

Figure 2:
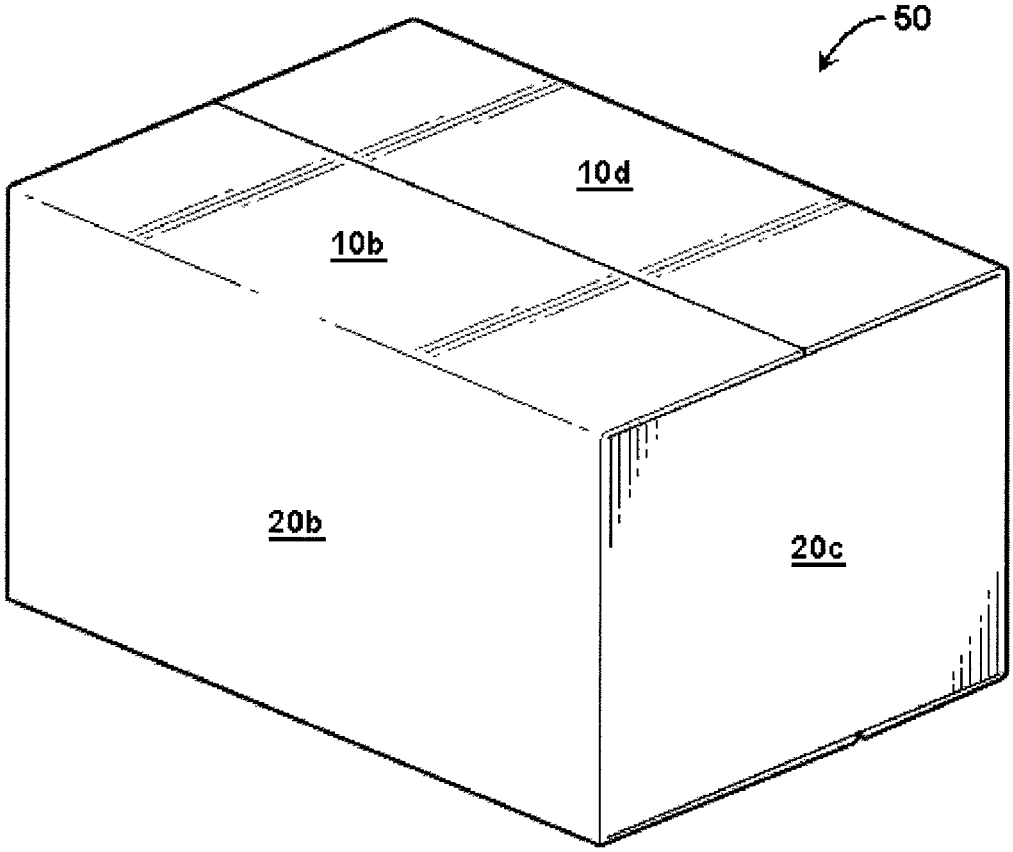
FIG. 2 is a top perspective view of a container that can be constructed with the one-piece blank shown in FIG. 1.

FIGS. 2-11 provide a non-limiting embodiment of a container 50 of the present invention. For instance, FIG. 2 illustrates a top perspective view of a container 50 that can be constructed with the blank 5 illustrated in FIG. 1. The container 50 has a rectangular shape. In other non-limiting embodiments, the container 50 can have other shapes (e.g., square). Top panels 10*b* and 10*d* have similar aspect ratios and are folded to enclose the interior space of the container 50. In other non-limiting embodiments, top panels 10*b* and 10*d* can have different aspect ratios.

Figure 3:
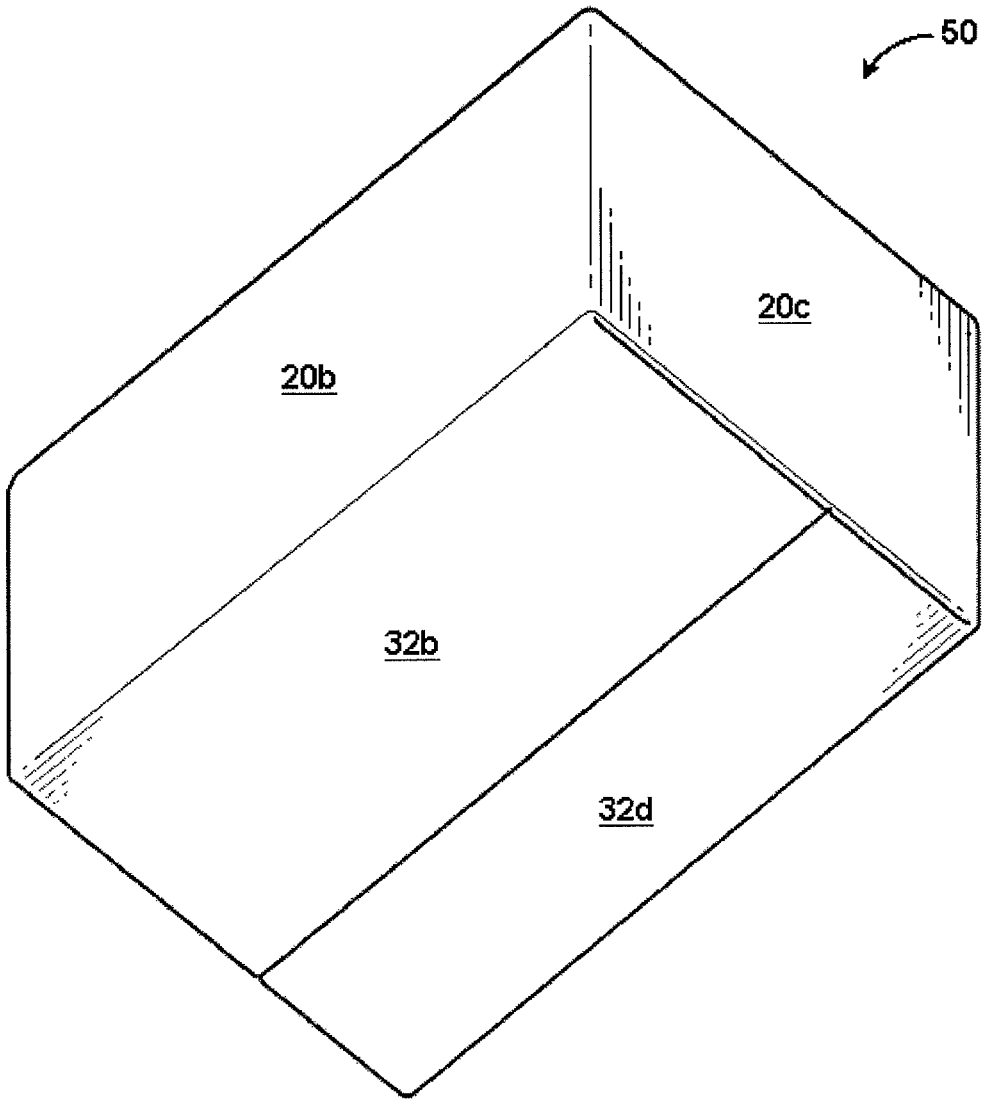
FIG. 3 is a bottom perspective view of the container shown in FIG. 2.

FIG. 3 illustrates a bottom perspective view of the container in FIG. 2. Bottom portions 32*b* and 32*d* form the outside bottom surface of the container 50. Bottom portions 32*b* and 32*d* have different aspect ratios. In other non-limiting embodiments, bottom portions 32*b* and 32*d* can have similar aspect ratios.

Figure 4:
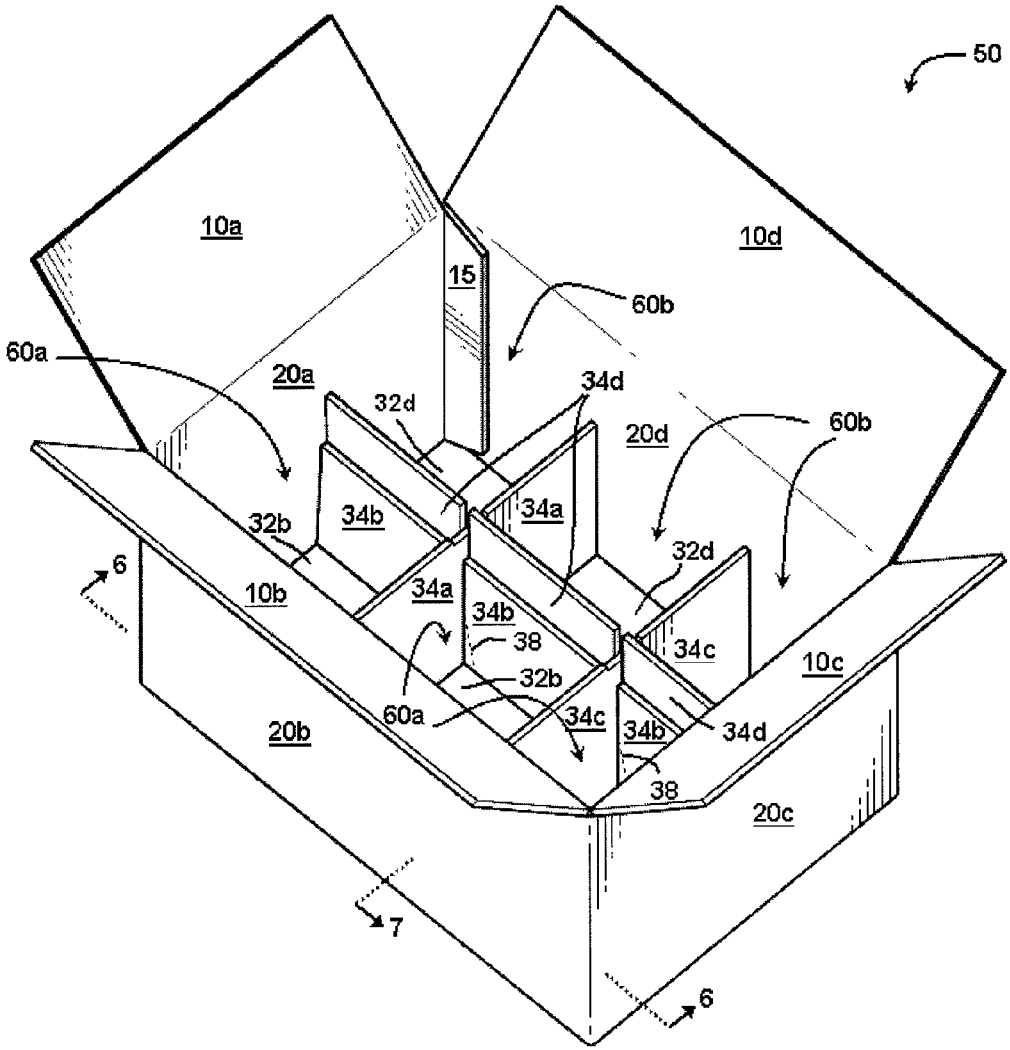
FIG. 4 is a top perspective view of the container shown in FIG. 2 in an open position.

FIG. 4 is a top perspective view of the container shown in FIG. 2 in an open position (e.g., top panels 10*a*, 10*b*, 10*c*, and 10*d*, are not folded downward to enclose the interior space of the container). Glue joint 15 is connected to side panel 20*d*, thereby defining an interior space of the container 50, where side panels 20*a* and 20*c* are in opposed relationship, and side panels 20*b* and 20*d* are in opposed relationship. Divider panels 34*a*, 34*b*, 34*c*, and 34*d* form cell walls that define two sets of three cells 60*a* and 60*b* (i.e., six cells in total). In this embodiment, cells 60*a* have a similar shape to one another and have a greater interior space when compared to cells 60*b*. Cells 60*b* have a similar shape to one another and have less interior space when compared to cells 60*a*. A person of ordinary skill in the art will recognize that the different shapes of the two sets of cells 60*a*, 60*b* can be created by varying the aspect ratios of bottom portions 32*b* and 32*d* or divider panels 34*b* and 34*d*. For instance, in this non-limiting embodiment, the aspect ratio of divider panel 34*b* is different than the aspect ratio of divider panel 34*d* in that divider panels 34*b* and 34*d* have the same length, but divider panel 34*d* has a greater height than divider panel 34*b*.

Figure 5:
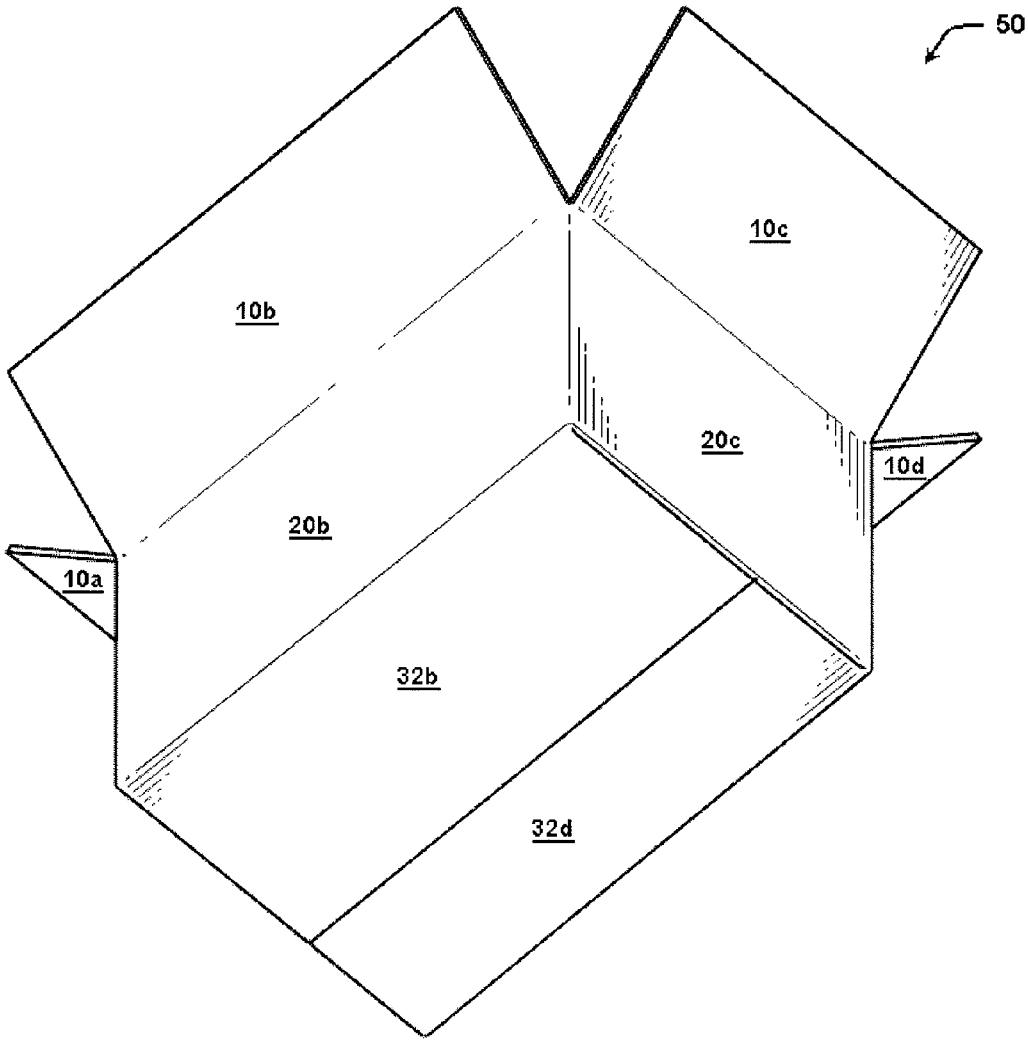
FIG. 5 is a bottom perspective view of the container shown in FIG. 4.

FIG. 5 is a bottom perspective view of the container 50 shown in FIG. 4. Bottom portions 32*b* and 32*d* form the outside bottom surface of the container 50 and have different aspect ratios. In this non-limiting embodiment, the aspect ratio of bottom portion 32*b* is different than the aspect ratio of bottom portion 32*d* in that bottom portions 32*b* and 32*d* have the same length, but bottom portion 32*b* has a greater width than bottom portion 32*d*. A person of ordinary skill in the art will recognize that the aspect ratios of bottom portions 32*b* and 32*d* can be varied by length or width as desired.

Figure 6:
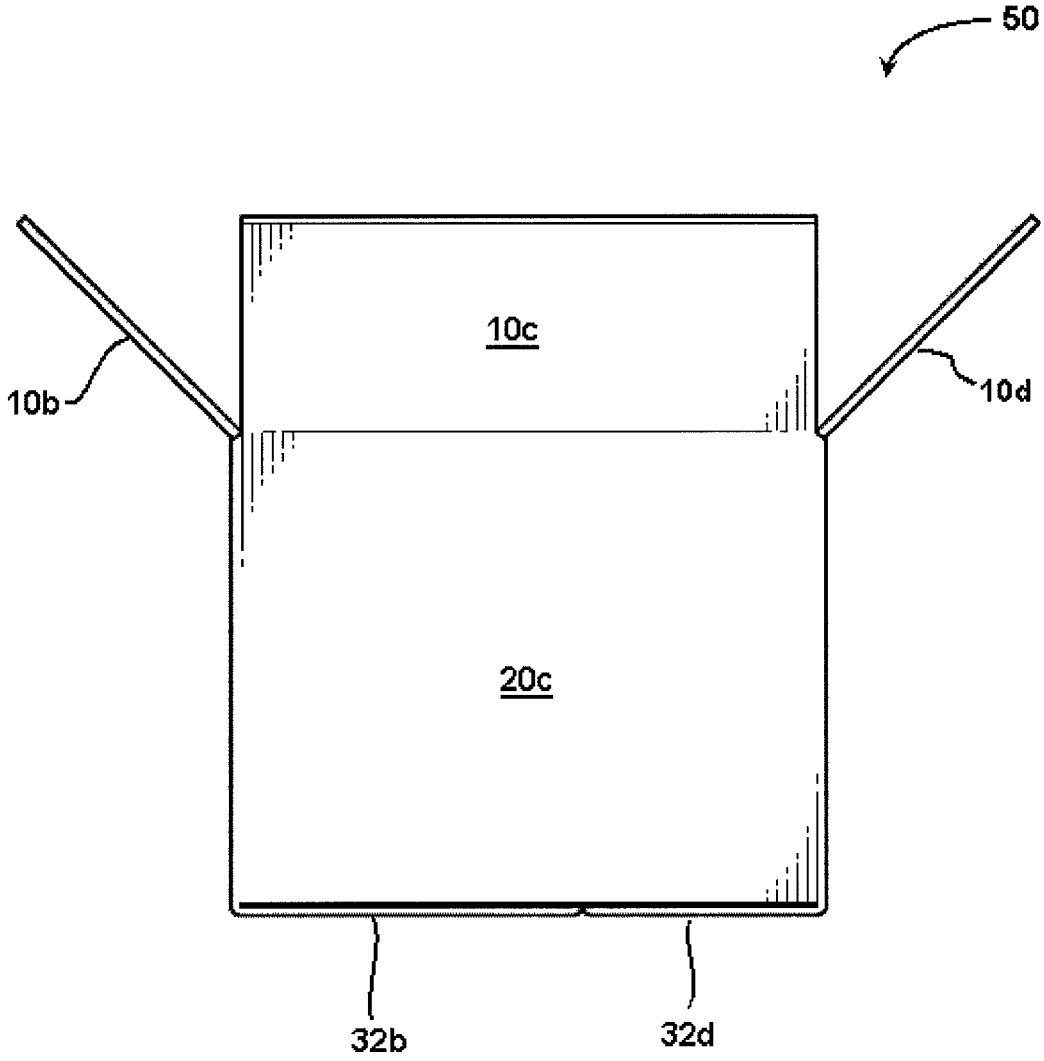
FIG. 6 is a front view of the container shown in FIG. 4.
Figure 7:
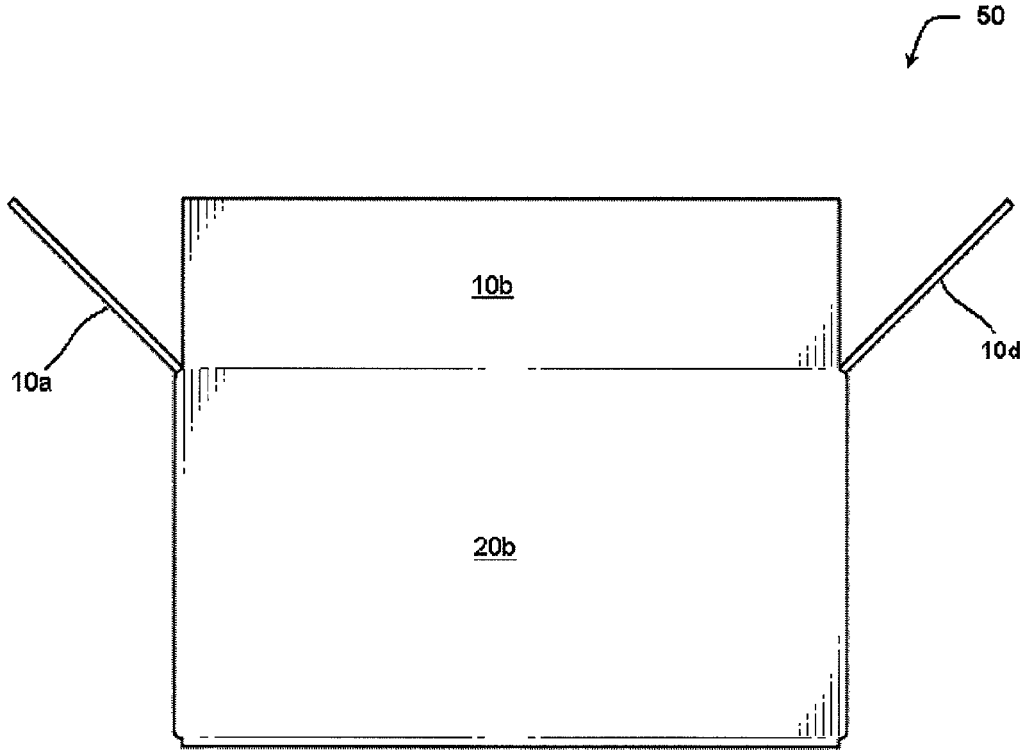
FIG. 7 is a side view of the container shown in FIG. 4.

FIG. 6 is a front view of the container 50 shown in FIG. 4. The bottom portions 32*b* and 32*d* form the outside bottom surface of the container 50 and have different aspect ratios in that bottom portion 32*b* has a greater width than bottom portion 32*d*. FIG. 7 is a side view of the container 50 shown in FIG. 4.

Figure 8:
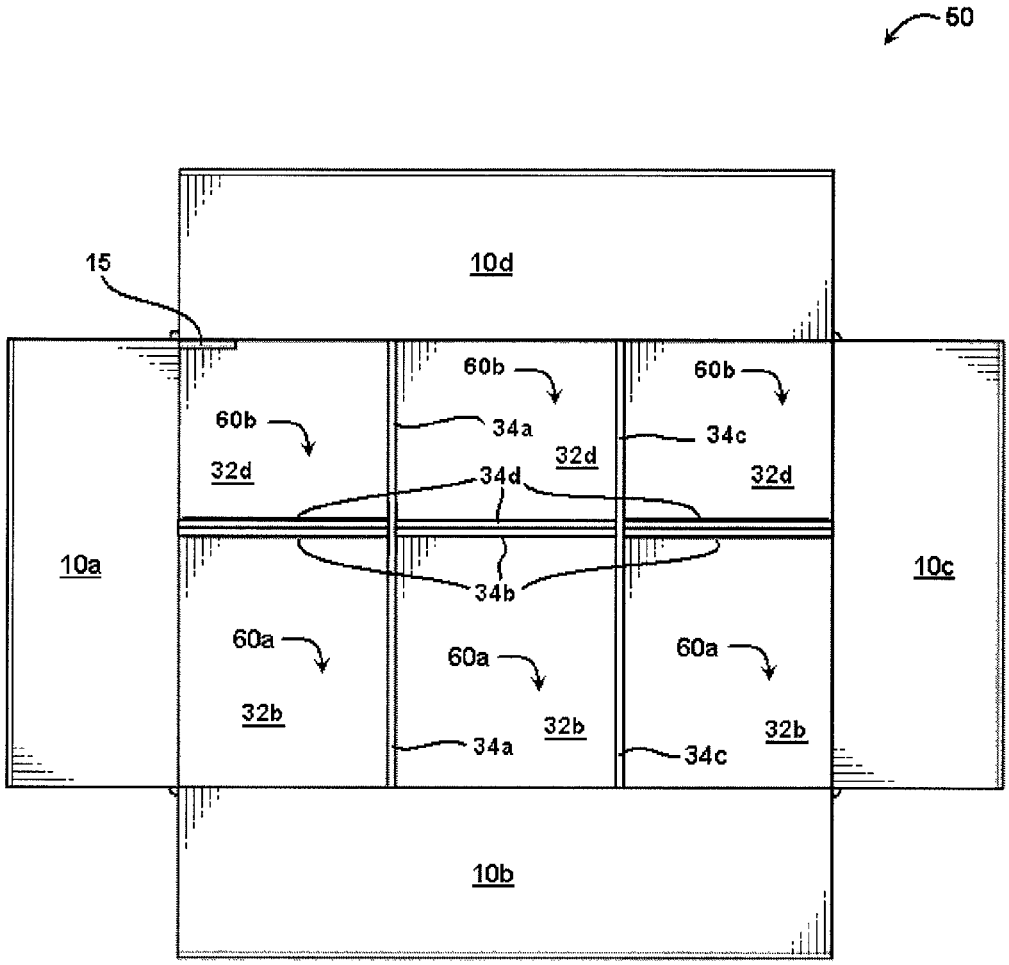
FIG. 8 is a top view of the container shown in FIG. 4.
Figure 9:
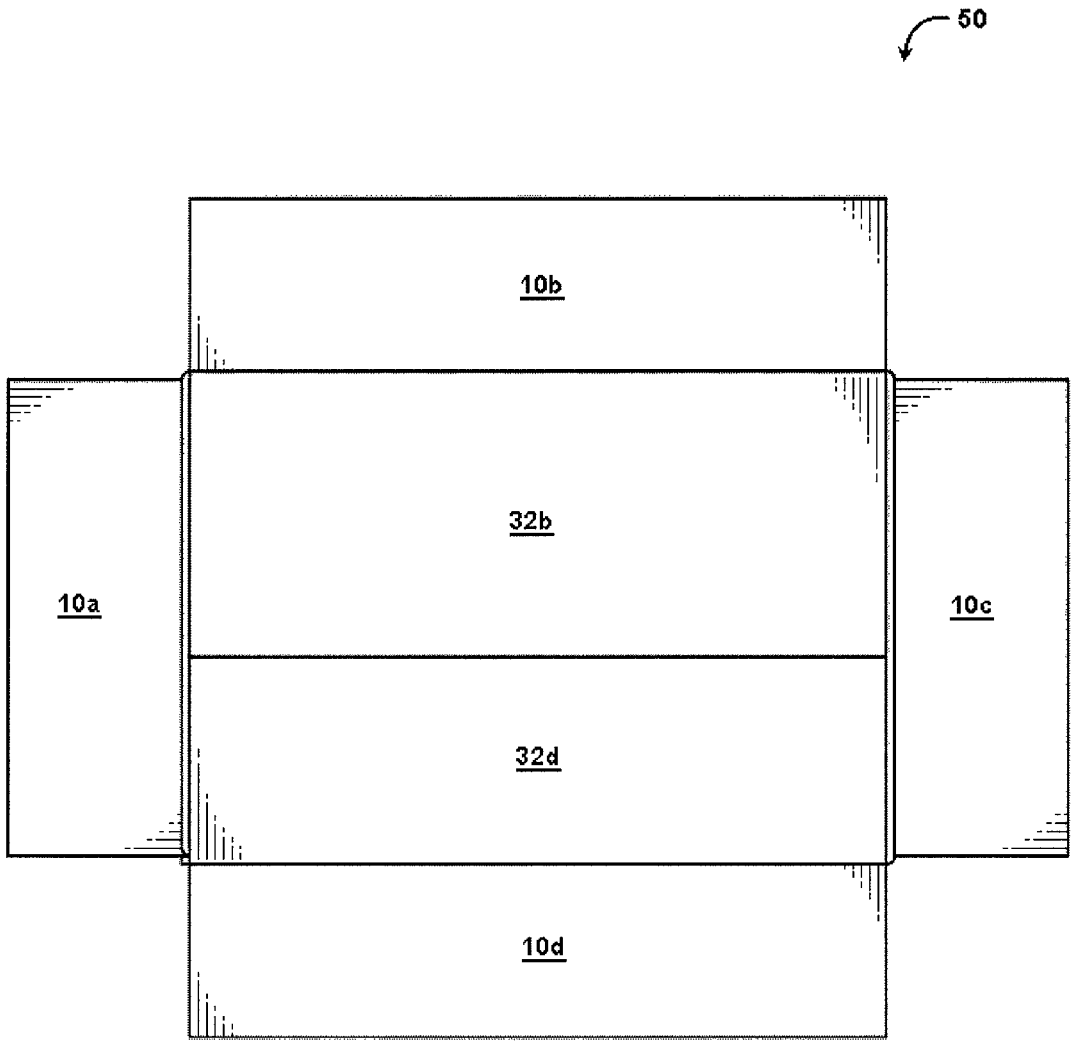
FIG. 9 is a bottom view of the container shown in FIG. 4.

FIG. 8 is a top view of the container 50 shown in FIG. 4. Cells 60*a* have a similar shape to one another and have a greater interior space when compared to cells 60*b*. Cells 60*b* have a similar shape to one another and have less interior space when compared to cells 60*a*. A person of ordinary skill in the art will recognize that the different shapes of the two sets of cells 60*a*, 60*b* can be created by varying the aspect ratios of bottom portions 32*b* and 32*d* or divider panels 34*b* and 34*d*. For instance, the aspect ratio of bottom portion 32*b* is different than the aspect ratio of bottom portion 32*d* in that bottom portions 32*b* and 32*d* have the same length, but bottom portion 32*b* has a greater width than bottom portion 32*d*. FIG. 9, which is a bottom view of the container 50 shown in FIG. 4, is also illustrative of the different aspect ratios of bottom portions 32*b* and 32*d*.

Figure 10:
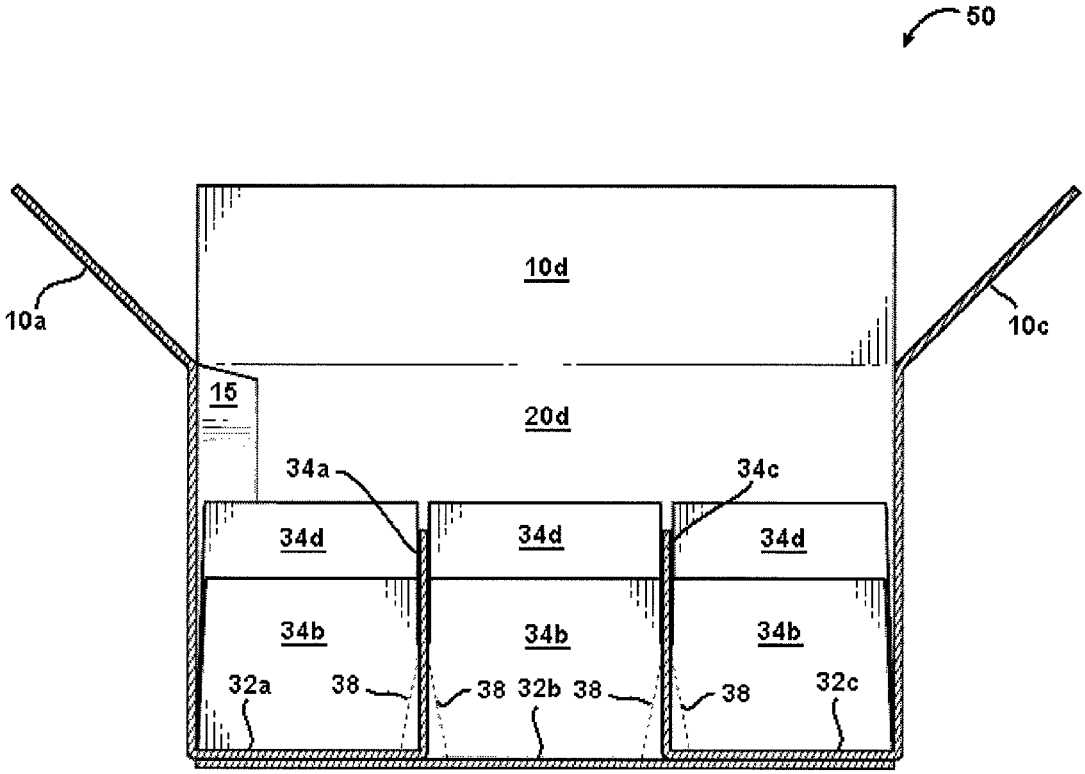
FIG. 10 is a cross-sectional view taken along line 6-6 of the container shown in FIG. 4.

FIG. 10 is a cross-sectional view taken along line 6-6 of the container 50 shown in FIG. 4. Glue joint 15 is connected to side panel 20*d*. Bottom portions 32*b* and 32*d* (32*d* not shown) form the outside bottom surface of the formed container 50. Bottom portions 32*a* and 32*c* form part of the inside bottom surface of the container 50. The aspect ratio of divider portion 34*d* is different than the aspect ratio of divider panel 34*b* in that divider portions 34*b* and 34*d* have the same width, but divider portion 34*d* has a greater height than divider portion 34*b*. Also, divider portions 34*a* and 34*c* have similar aspect ratios in that they have the same width (not shown) and height.

Figure 11:
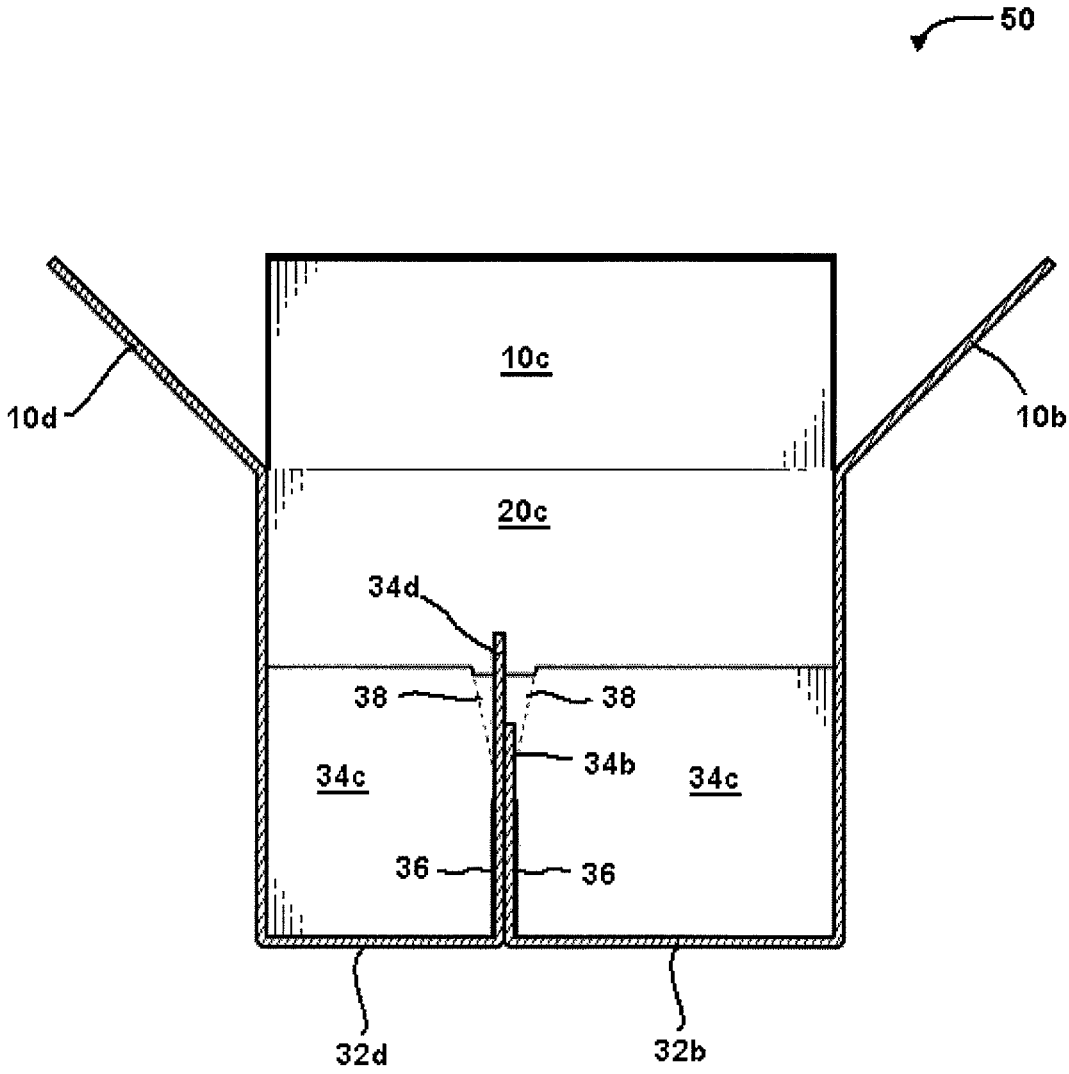
FIG. 11 is a cross-sectional view taken along line 7-7 of the container shown in FIG. 4.

FIG. 11 is a cross-sectional view taken along line 7-7 of the container shown in FIG. 4. Bottom portions 32*b* and 32*d* form the outside bottom surface of the formed container 50. The aspect ratio of divider portion 34*d* is different than the aspect ratio of divider panel 34*b* in that divider portions 34*b* and 34*d* have the same width (not shown), but divider portion 34*d* has a greater height than divider portion 34*b*. The elongated slits 40 (not shown) on divider portions 34*b* and 34*d* can be configured to communicate with the elongated opening 36 of bottom panel 30*c*.

C. Assembly

Figure 12:
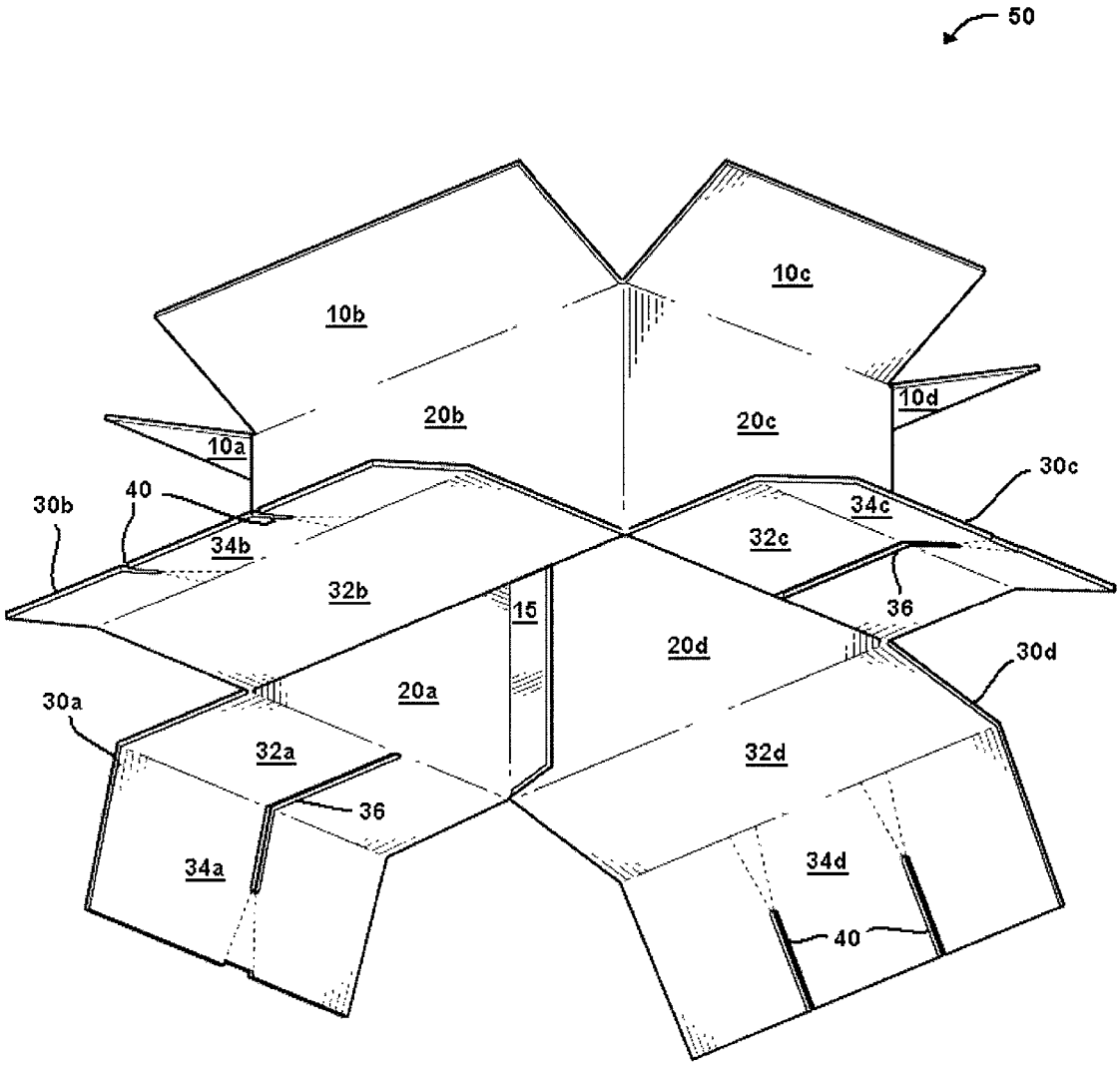
FIG. 12 is a perspective view of the container shown in FIG. 2 in a partially assembled condition.
Figure 13:
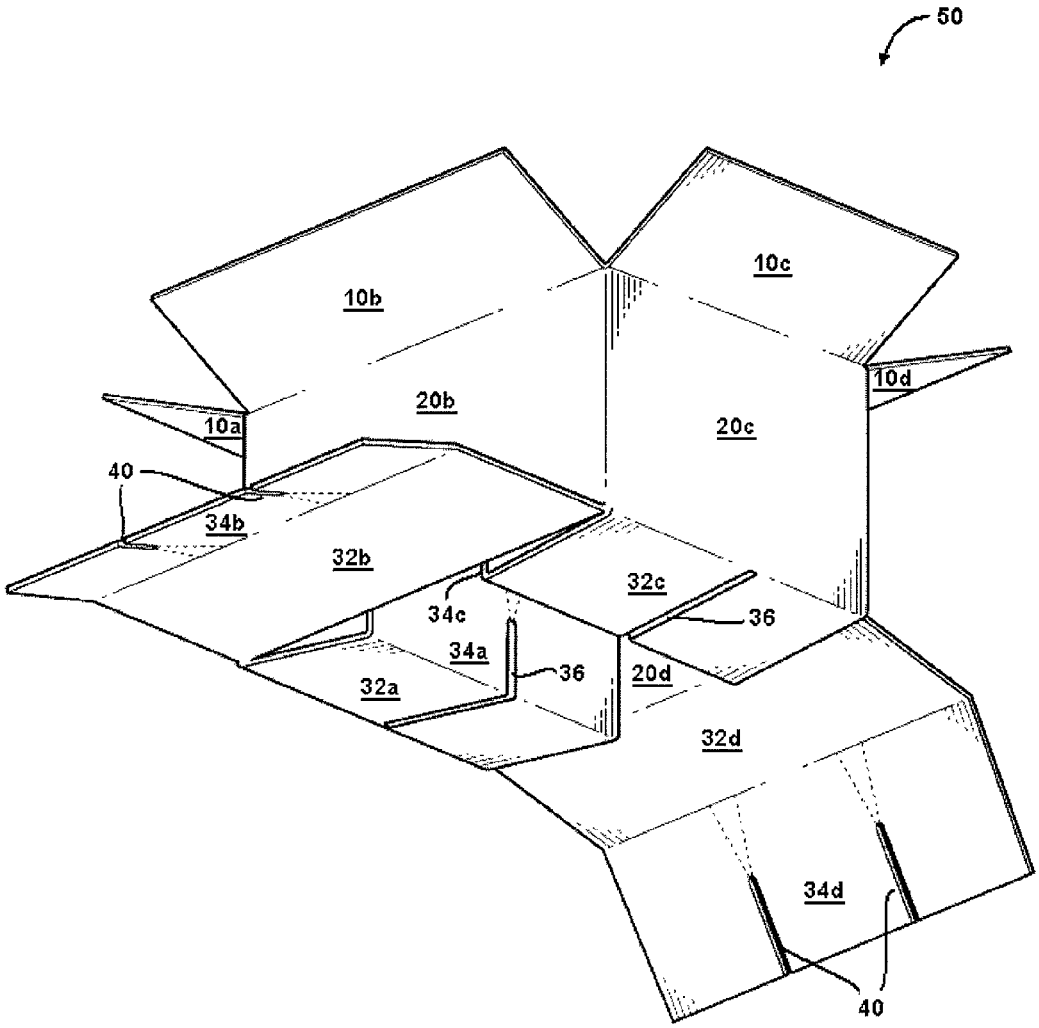
FIG. 13 is a perspective view of the container shown in FIG. 12 in a later stage of assembly.
Figure 14:
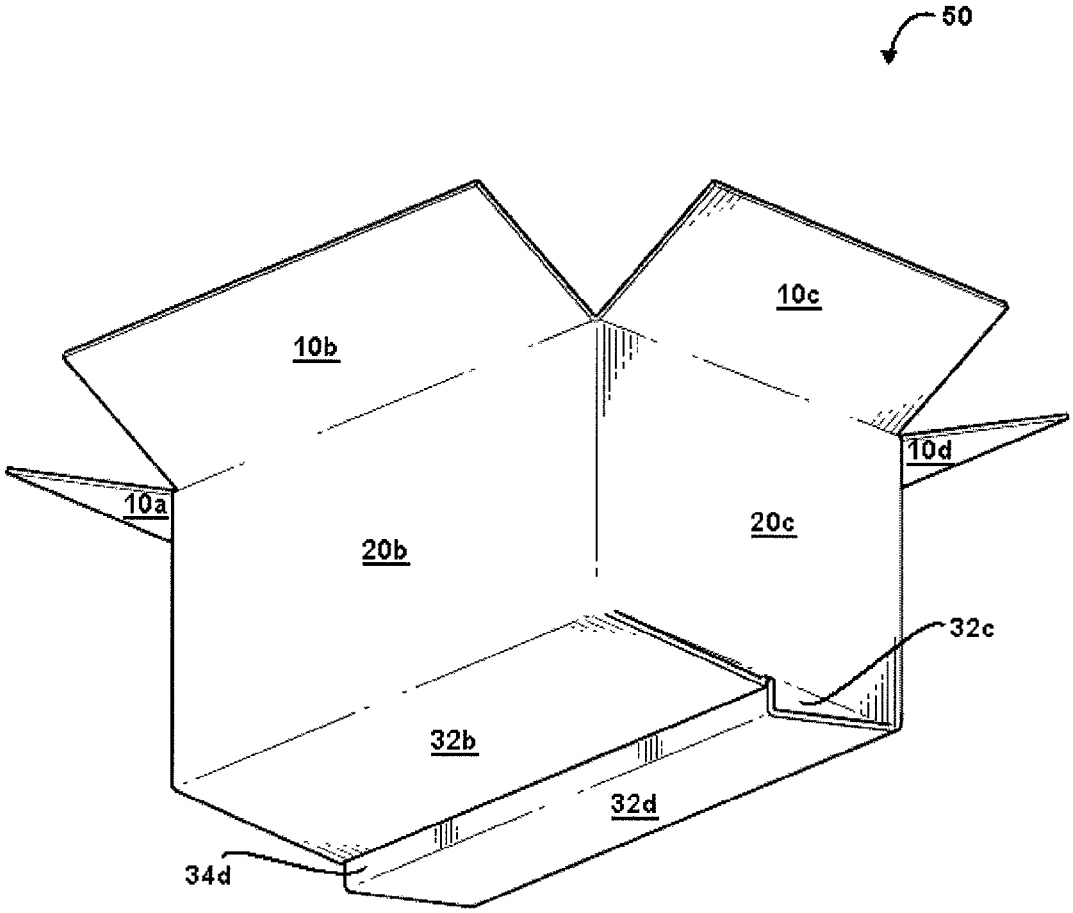
FIG. 14 is a perspective view of the container shown in FIG. 13 in a later stage of assembly.

FIGS. 12-14 provide a non-limiting illustration of assembling the container 50 illustrated in FIG. 4. In FIG. 12, glue joint 15 is connected to side panel 20*d*, thereby defining an interior space of the container 50, where side panels 20*a* and 20*c* are in opposed relationship, and side panels 20*b* and 20*d* are in opposed relationship. In FIG. 13, bottom portions 32*a* and 32*c* are folded along fold lines 16 towards the interior space of the container 50. Divider portions 34*a* and 34*c* are folded along fold lines 18 and extend into the interior space of the container 50. Bottom portions 32*a* and 32*c* form at least part of the inside bottom surface of the container 50. In FIG. 14, divider portions 34*b* and 34*d* are folded along fold lines 18 and extend into the interior space of the container 50. The elongated slits 40 on divider portions 34*b* and 34*d* communicate with the elongated openings 36 of bottom panels 30*a* and 30*c*. Bottom portions 32*b* and 32*d* form the outside bottom surface of the container 50.

D. Alternative Embodiment

Figure 15:
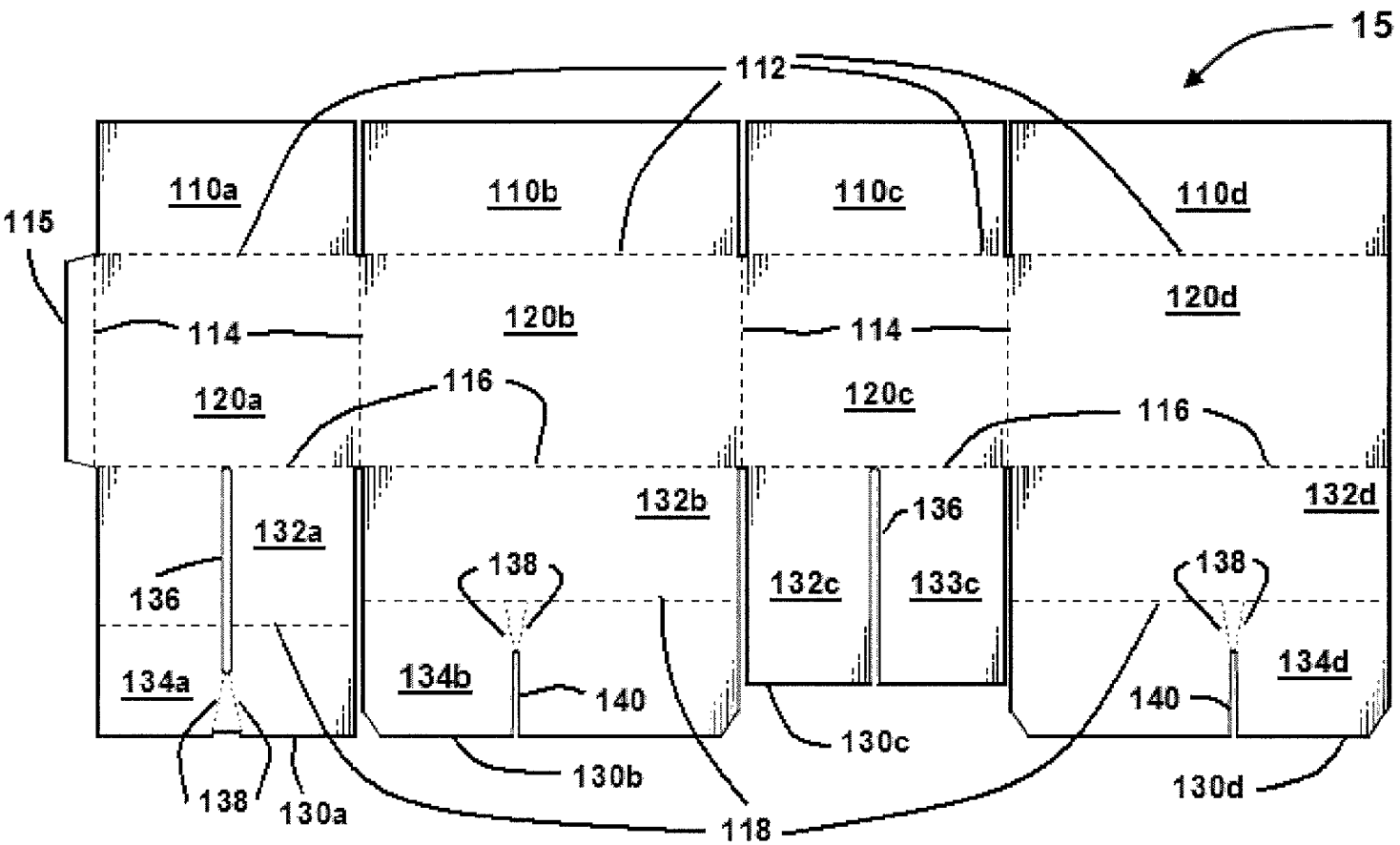
FIG. 15 is a plain view of a one-piece blank that can be used to construct a second embodiment of a container of the present invention.

FIG. 15 shows a blank 15 that can be used to construct a second embodiment of a container according to this disclosure. This embodiment is constructed in accordance with the same general principles as the embodiment described in FIGS. 1-14. The embodiment constructed from blank 15 has four cells instead of six cells as shown in the previous embodiment described in FIGS. 1-14.

The blank 15 includes four top panels 110*a*, 110*b*, 110*c*, and 110*d*, which can be configured to form a top portion of the constructed container. The blank 15 also includes four side panels 120*a*, 120*b*, 120*c*, and 120*d*, and four bottom panels 130*a*, 130*b*, 130*c*, and 130*d*. A glue joint 115 is coupled to side panel 120*a*. When the blank 15 is constructed into a container, the glue joint 115 can be used to connect itself to side panel 120*d*, thereby defining an interior space of the container, where side panels 120*a* and 120*c* are in opposed relationship, and side panels 120*b* and 120*d* are in opposed relationship. In a non-limiting embodiment, the connection can be made by using an adhesive. However, the connection can be made in other ways (e.g., mechanical devices such as a staple, a screw, a nail, a clamp, etc.). In other embodiments, glue joint 115 can be coupled to side panel 120*d* and can be configured to connect side panel 120*d* to side panel 120*a*

Fold lines 112 define boundaries between each top panel 110*a*, 110*b*, 110*c*, and 110*d* and each corresponding side panel 120*a*, 120*b*, 120*c*, and 120*d*. Fold lines 114 define boundaries between the glue joint 115 and side panel 120*a* and between side panels 120*a*, 120*b*, 120*c*, and 120*d*. Fold lines 116 define boundaries between each side panel 120*a*, 120*b*, 120*c*, and 120*d* and each corresponding bottom panel 130*a*, 130*b*, 130*c*, and 130*d*.

Each bottom panel 130*a*, 130*b*, and 130*d* comprises a bottom portion 132*a*, 132*b*, and 132*d*. Bottom panel 130*c* comprises bottom portions 132*c* and 133*c*. Bottom panels 130*a*, 130*b*, and 130*d* also comprise a divider portion 34*a*, 34*b*, and 34*d*. Bottom panels 130*a* and 130*c* each comprise an elongated opening 136 that can be configured to accept at least part of divider portions 134*b* and 134*d* when the container is formed.

Fold lines 118 define boundaries between each bottom portion 132*a*, 132*b*, and 132*d* and each corresponding divider portion 134*a*, 134*b*, and 134*d*. The distance between fold line 116 and fold line 118 of bottom panel 130*b* is substantially similar to the distance between fold line 116 and fold line 118 of bottom panel 130*d*. The distance between fold line 116 and 118 in bottom panels 130*b* and 130*d* is slightly less than the distance between fold line 116 and 118 in bottom panel 130*a*. In other non-limiting embodiments, the distance between fold line 116 and fold line 118 of bottom panel 130*a* can be different (e.g., equal to or less than) when compared to the distance between fold line 116 and fold line 118 of bottom panels 130*b* and 130*d*. Divider portions 134*b* and 134*d* have substantially similar aspect ratios. In other non-limiting embodiments, divider portions 134*b* and 134*d* can have different aspect ratios. Divider portions 134*a*, 134*b*, and 134*d* can be configured to extend into the interior of the formed container. Each divider portion 134*a*, 134*b*, and 134*d* includes cut lines 138 that allow a user to reconfigure the interior space of the formed container. For example, the cut lines 38 can be separated or cut along the indicated line 38. This allows the interior space of the formed container to include 0, 1, 2, 3, or 4 individual cells by folding selected parts of the divider portions 134*a*, 134*b*, and 134*d* downward to the bottom surface of the formed container. Divider portions 134*b* and 134*d* also include elongated slits 140 which can facilitate the positioning of divider portions 134*b* and 134*d* with respect to divider portion 134*a* when the container is constructed.

Figure 16:
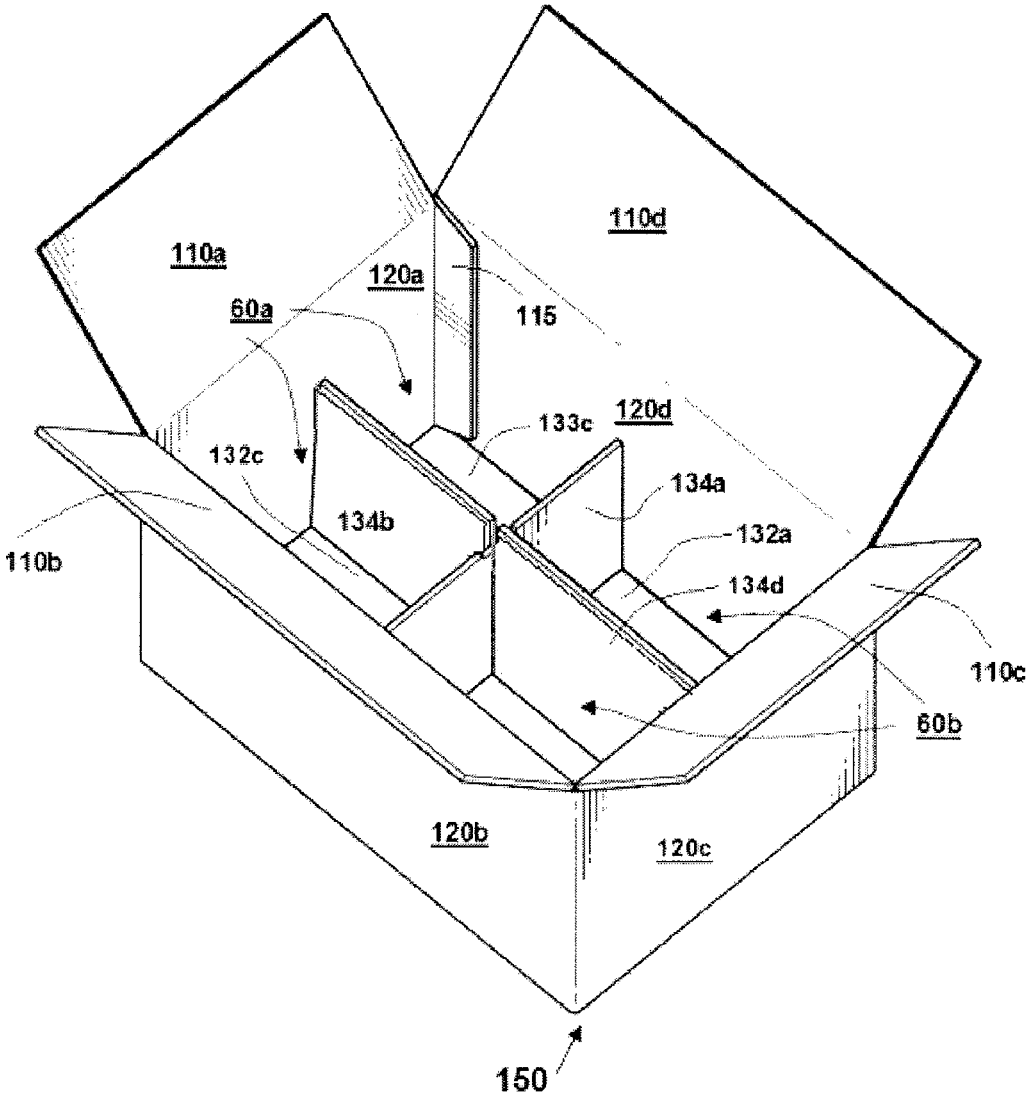
FIG. 16 is a top perspective view of a container that can be constructed with the one-piece blank shown in FIG. 15 in an open position.

FIGS. 16-21 provide a non-limiting embodiment of a container 150 constructed from the blank 115 shown in FIG. 15. FIG. 16 represents a top perspective view of container 150 in an open position (e.g., top panels 110*a*, 110*b*, 110*c*, and 110*d*, are not folded downward to enclose the interior space of the container). Glue joint 115 is connected to side panel 120*d*, thereby defining an interior space of container 150, where side panels 120*a* and 120*b* are in opposed relationship, and side panels 120*b* and 120*d* are in opposed relationship. Divider panels 134*a*, 134*b*, and 134*d* form cell walls that define two sets of two cells 160*a* and 160*b* (i.e., four cells in total). A person of ordinary skill in the art will recognize that the different shapes of the two sets of cells 160*a* and 160*b* can be created by varying the aspect ratios of bottom portions 132*b* and 132*d* or divider panels 134*b* and 134*d*.

Figure 17:
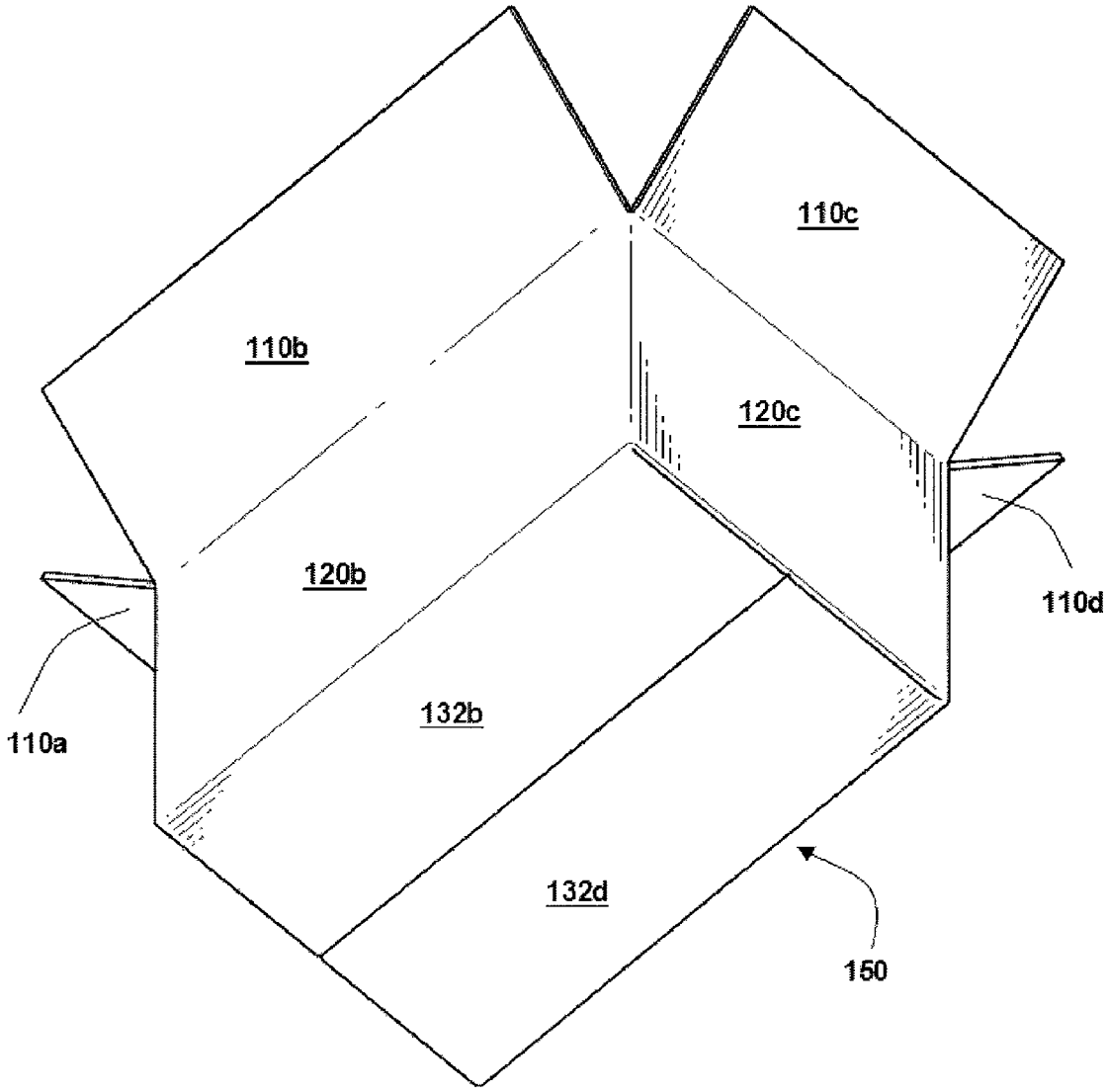
FIG. 17 is a bottom perspective view of the container shown in FIG. 16.

FIG. 17 is a bottom perspective view of the container 150 shown in FIG. 16. Bottom portions 132*b* and 132*d* form the outside bottom surface of the container 150 and have equivalent aspect ratios. A person of ordinary skill in the art will recognize that the aspect ratios of bottom portions 132*b* and 132*d* can be varied by length or width as desired.

Figure 18:
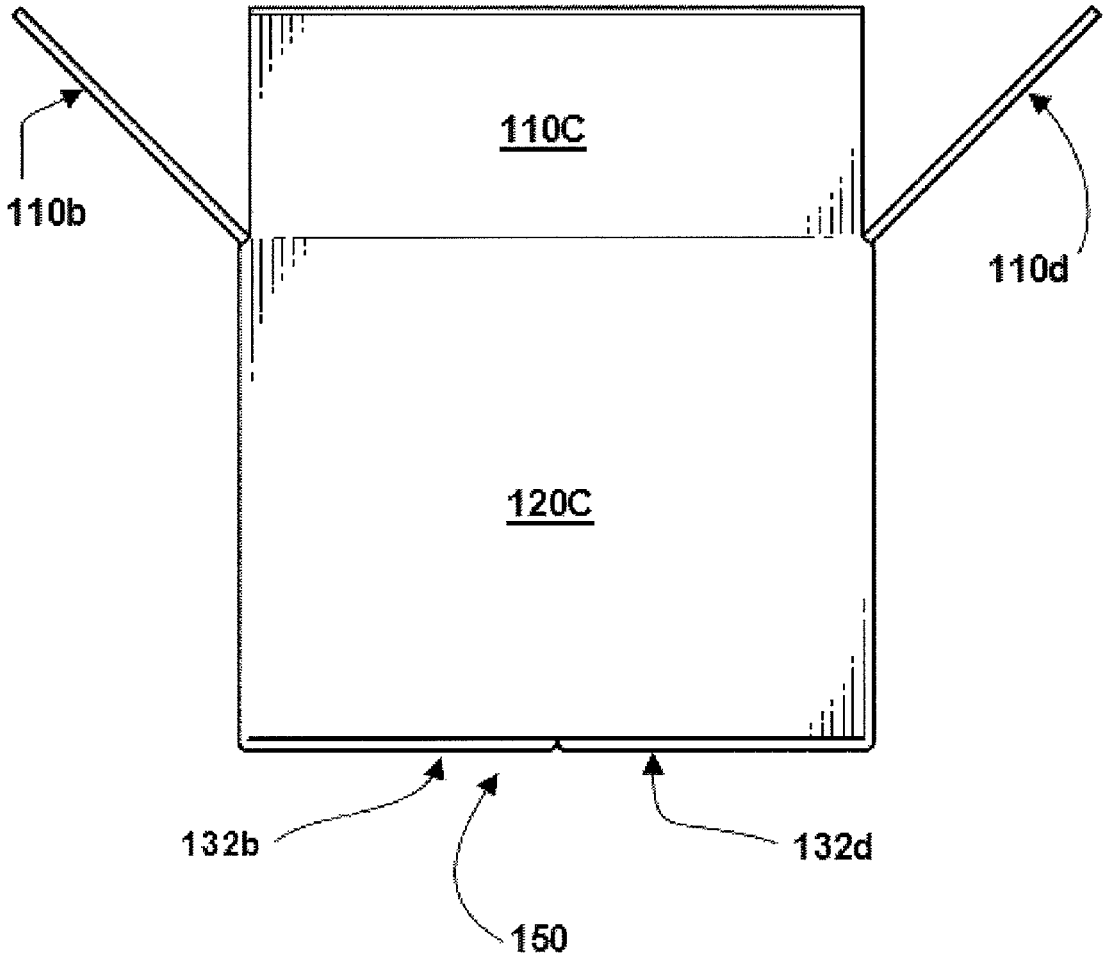
FIG. 18 is a front view of the container shown in FIG. 16.
Figure 19:
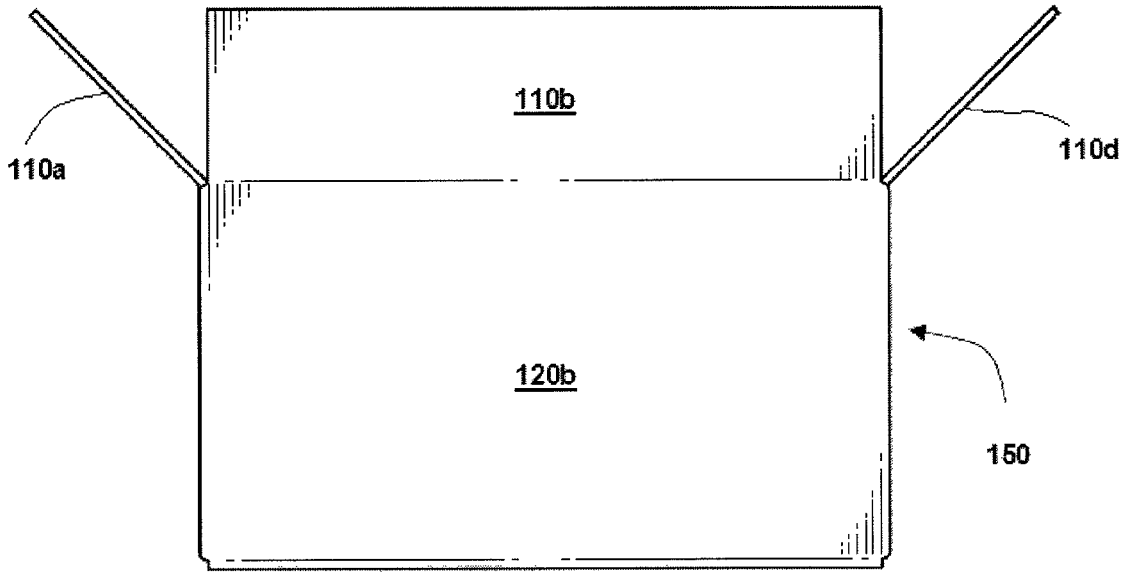
FIG. 19 is a side view of the container shown in FIG. 16.

FIG. 18 is a front view of the container 150 shown in FIG. 16. The bottom portions 132*b* and 132*d* form the outside bottom surface of the container 150. FIG. 19 is a side view of the container 150 shown in FIG. 16.

Figure 20:
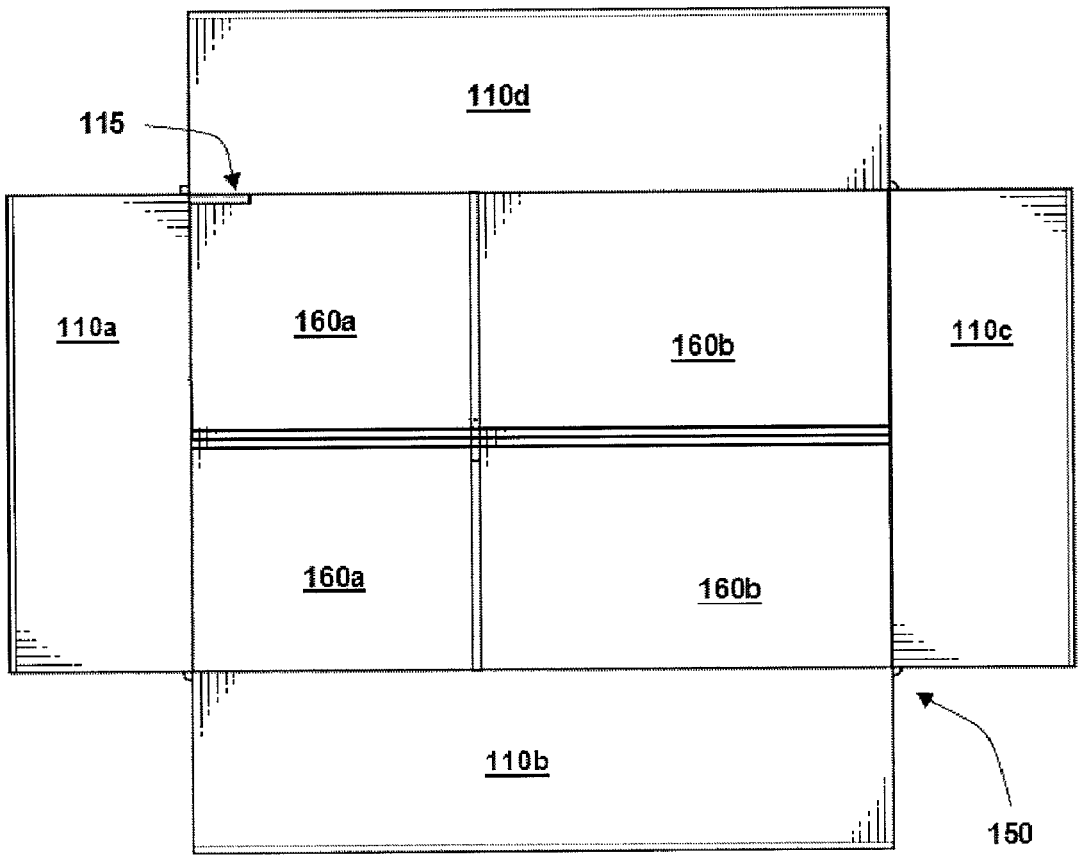
FIG. 20 is a top view of the container shown in FIG. 16.
Figure 21:
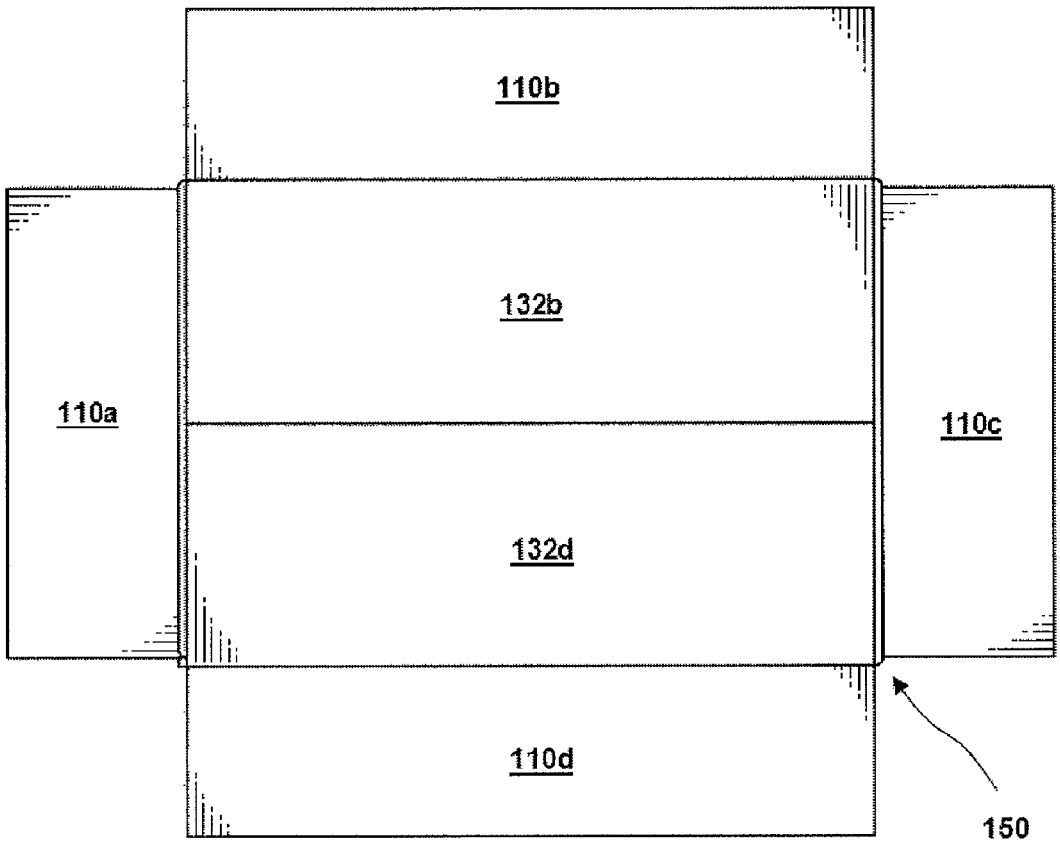
FIG. 21 is a bottom view of the container shown in FIG. 20.

FIG. 20 is a top view of the container 150 shown in FIG. 16. Cells 160*b* have a similar shape to one another and have a greater interior space when compared to cells 160*a*. A person of ordinary skill in the art will recognize that the different shapes of the two sets of cells 60*a*, 60*b* can be created by varying the aspect ratios of bottom portions 32*b* and 32*d* or divider panels 34*b* and 34*d*. FIG. 21, which is a bottom view of the container 150 shown in FIG. 16, is also illustrative of the equivalent aspect ratios of bottom portions 132*b* and 132*d*.

* * *

All of the container and/or methods disclosed and claimed in this specification can be made and executed without undue experimentation in light of the present disclosure. While the container and methods of this invention have been described in terms of certain embodiments, it will be apparent to those of skill in the art that variations may be applied to the containers and/or methods and in the steps or in the sequence of steps described herein without departing from the concept, spirit and scope of the invention.

The invention claimed is:

1. A container comprising:

a first, second, third, and fourth side wall panel, wherein the first and third side wall panels are in opposed relationship, and wherein the second and fourth side wall panels are in opposed relationship, the side wall panels defining an interior space of the container;

a first second, third, and fourth bottom panel, wherein the first bottom panel is coupled to the first side wall panel, the second bottom panel is coupled to the second side wall panel, the third bottom panel is coupled to the third side wall panel, and the fourth bottom panel is coupled to the fourth side wall panel, and wherein each bottom panel comprises:

(a) a divider portion that extends into the interior of the container and is configured to form a cell wall that defines a cell; and (b) a bottom portion;

wherein the divider portions of the second and fourth bottom panels have different aspect ratios, wherein a first fold line defines a boundary between each side wall panel and each bottom panel, and wherein a second fold line defines a boundary between the divider portion and the bottom portion of each bottom panel, and wherein the distance between the first fold line and second fold line of the second bottom panel is greater than the distance between the first fold line and second fold line of the fourth bottom panel.

2. The container of claim 1, wherein the divider portions of the first and third bottom panels have the same aspect ratio.

3. The container of claim 1, wherein the distance between the first fold line and the second fold line of the first bottom panel is substantially similar to the distance between the first fold line and the second fold line of the third bottom panel.

4. The container of claim 1, wherein the first side wall panel further comprises a glue joint.

5. The container of claim 1, wherein each divider portion is capable of being folded in such a way that the interior space of the container is either not divided or else it is divided into one, two, three, four, five, or six cells.

6. The container of claim 1, wherein the bottom portion of the second and fourth bottom panels form the outside surface of the bottom of the container.

7. The container of claim 1, wherein the first and third bottom panels further comprise elongated openings that are configured to accept the divider portions of the second and fourth bottom panels.

8. The container of claim 1, wherein the interior space of the container is divided into six cells.

9. The container of claim 8, wherein the six cells are divided into two sets of three, and wherein the first set of cells have the same shape and have a smaller interior space in comparison to the second set of cells.

10. The container of claim 9, wherein the second set of cells have the same shape.

11. The container of claim 1, wherein the first and third bottom panels have the same aspect ratio, and the second and fourth bottom panels have the same aspect ratio.

12. The container of claim 11, wherein the aspect ratios of the first and third bottom panels are different when compared to the aspect ratios of the second and fourth bottom panels.

13. A container comprising:

a first, second, third, and fourth side wall panel, wherein the first and third side wall panels are in opposed relationship, and wherein the second and fourth side wall panels are in opposed relationship, the side wall panels defining an interior space of the container;

a first second, third, and fourth bottom panel, wherein the first bottom panel is coupled to the first side wall panel, the second bottom panel is coupled to the second side wall panel, the third bottom panel is coupled to the third side wall panel, and the fourth bottom panel is coupled to the fourth side wall panel, and wherein each bottom panel comprises:

(a) a divider portion that extends into the interior of the container and is capable of being folded in such a way that the interior space of the container is either not divided or else it is divided into at least one, two, three, four, five, or six cells; and (b) a bottom portion, wherein a first fold line defines a boundary between each side wall panel and each bottom panel, and wherein a second fold line defines a boundary between the divider portion and the bottom portion of each bottom panel, wherein the distance between the first fold line and the second fold line of the second bottom panel is greater than the distance between the first fold line and second fold line of the fourth bottom panel, and wherein the divider portions of the second and fourth bottom panels have different aspect ratios.

14. The container of claim 13, wherein the divider portions of the first and third bottom panels have the same aspect ratio.

15. The container of claim 13, wherein the distance between the first fold line and the second fold line of the first bottom panel is identical to the distance between the first fold line and the second fold line of the third bottom panel.

16. The container of claim 13, wherein the first and third bottom panels have the same aspect ratio, and the second and fourth bottom panels have the same aspect ratio.

17. The container of claim 16, wherein the aspect ratios of the first and third bottom panels are different when compared to the aspect ratios of the second and fourth bottom panels.

18. A single blank of material for constructing a container comprising:

a first, second, third, and fourth side wall panel, wherein the first and third side wall panels are in opposed relationship, and wherein the second and fourth side wall panels are in opposed relationship, the side wall panels being configured to define an interior space when the container is formed;

a glue joint coupled to the first side wall panel;

a first second, third, and fourth bottom panel, wherein the first bottom panel is coupled to the first side wall panel, the second bottom panel is coupled to the second side wall panel, the third bottom panel is coupled to the third side wall panel, and the fourth bottom panel is coupled to the fourth side wall panel, and wherein each bottom panel comprises:

(a) a divider portion that is configured to extend into the interior of the container when the container is formed; and (b) a bottom portion, wherein the divider portions of the first and third bottom panels have the same aspect ratio and the divider portions of the second and fourth bottom panels have different aspect ratios, and wherein the bottom portions of the first, second, third, and fourth bottom panels have a rectangular shape.

19. The blank of claim 18, wherein the first and third bottom panels have the same aspect ratio, and the second and fourth bottom panels have the same aspect ratio.

20. The blank of claim 19, wherein the aspect ratios of the first and third bottom panels are different when compared to the aspect ratios of the second and fourth bottom panels.

21. A container comprising:

a first, second, third, and fourth side wall panel, wherein the first and third side wall panels are in opposed relationship, and wherein the second and fourth side wall panels are in opposed relationship, the side wall panels defining an interior space of the container;

a first second, third, and fourth bottom panel, wherein the first bottom panel is coupled to the first side wall panel, the second bottom panel is coupled to the second side wall panel, the third bottom panel is coupled to the third side wall panel, and the fourth bottom panel is coupled to the fourth side wall panel, wherein a first fold line defines a boundary between each side wall panel and each bottom panel, and wherein each bottom panel comprises:

(a) a divider portion that extends into the interior of the container and is configured to form a cell wall that defines a cell; and (b) a bottom portion, wherein a second fold line defines a boundary between the divider portion and the bottom portion of each bottom panel, wherein the distance between the first fold line and the second fold line of the second bottom panel is greater than the distance between the first fold line and second fold line of the fourth bottom panel, and wherein the distance between the first fold line and the second fold line of the first bottom panel is identical to the distance between the first fold line and the second fold line of the third bottom panel.

22. The container of claim 21, wherein the first and third bottom panels have the same aspect ratio, and the second and fourth bottom panels have the same aspect ratio.

23. The container of claim 22, wherein the aspect ratios of the first and third bottom panels are different when compared to the aspect ratios of the second and fourth bottom panels.

24. A container comprising:

a first, second, third, and fourth side wall panel, wherein the first and third side wall panels are in opposed relationship, and wherein the second and fourth side wall panels are in opposed relationship, the side wall panels defining an interior space of the container;

a first, second, third, and fourth bottom panel, wherein the first bottom panel is coupled to the first side wall panel, the second bottom panel is coupled to the second side wall panel, the third bottom panel is coupled to the third side wall panel, and the fourth bottom panel is coupled to the fourth side wall panel, and wherein the first, second, and fourth bottom panels each comprise:

(a) a divider portion that extends into the interior of the container and is capable of forming a cell wall defining a cell and/or a portion of the bottom of the container; and (b) a bottom portion, wherein the third bottom panel includes a bottom portion but not a divider portion, a first, second, third, and fourth top panel, wherein the first top panel is coupled to the first side wall panel, the second top panel is coupled to the second side wall panel, the third top panel is coupled to the third side wall panel, and the fourth top panel is coupled to the fourth side wall panel, wherein the first, second, third, and fourth top panels each have a rectangular shape, and wherein the first and third bottom panels each further comprise an elongated opening that is configured to accept the divider portions of the second and fourth bottom panels.

25. The container of claim 24, wherein the interior space of the container is either not divided or else it is divided into one, two, three, four, five, or six cells.

26. The container of claim 24, wherein the second and fourth bottom panels have the same aspect ratio.

27. The container of claim 24, wherein the second and fourth bottom panels have the same shape.

* * * * *